US009356407B2

(12) United States Patent
Nakamura

(10) Patent No.: US 9,356,407 B2
(45) Date of Patent: May 31, 2016

(54) CONNECTOR HAVING A TERMINAL WITH A COUPLING PORTION COUPLING A FIRST PORTION HAVING A CONTACT POINT WITH A SECOND PORTION

(71) Applicant: JAPAN AVIATION ELECTRONICS INDUSTRY, LIMITED, Shibuya-ku, Tokyo (JP)

(72) Inventor: Keisuke Nakamura, Tokyo (JP)

(73) Assignee: JAPAN AVIATION ELECTRONICS INDUSTRY, LIMITED, Shibuya-Ku, Tokyo (JP)

( * ) Notice: Subject to any disclaimer, the term of this patent is extended or adjusted under 35 U.S.C. 154(b) by 0 days.

(21) Appl. No.: 14/576,100

(22) Filed: Dec. 18, 2014

(65) Prior Publication Data

US 2015/0214681 A1 Jul. 30, 2015

(30) Foreign Application Priority Data

Jan. 29, 2014 (JP) ..... 2014-014459

(51) Int. Cl.
*H01R 12/00* (2006.01)
*H01R 24/68* (2011.01)
(Continued)

(52) U.S. Cl.
CPC ..... *H01R 24/68* (2013.01); *H01R 12/716* (2013.01); *H01R 12/73* (2013.01); *H01R 13/11* (2013.01); *H01R 13/631* (2013.01); *H01R 2107/00* (2013.01)

(58) Field of Classification Search
CPC ..... H01R 24/68; H01R 13/631
USPC ..... 439/65, 69, 74, 374
See application file for complete search history.

(56) References Cited

U.S. PATENT DOCUMENTS 5,409,406 A 4/1995 McClure et al.
5,478,248 A 12/1995 Mitra et al.
(Continued)

FOREIGN PATENT DOCUMENTS

JP 09506734 A 6/1997
JP 09506735 A 6/1997
(Continued)

OTHER PUBLICATIONS

Korean Office Action (and English translation thereof) dated Dec. 8, 2015, issued in counterpart Korean Application No. 10-2014-0173493.

*Primary Examiner* — Chandrika Prasad
(74) *Attorney, Agent, or Firm* — Holtz, Holtz & Volek PC

(57) ABSTRACT

Along an up-down direction, a connector is mateable with a mating connector which includes a plurality of mating terminals each having a mating contact point. The connector comprises a plurality of terminals which are, at least in part, accommodated by a housing. The terminals are arranged in a first direction perpendicular to the up-down direction. Each of the terminals has a first portion, a second portion and a coupling portion. The first portion includes a contact point and a guiding portion. The contact point is positioned apart from the second portion in a second direction perpendicular to both the up-down direction and the first direction. The contact point is in contact with the mating contact point while the mating contact point is positioned between the contact point and the second portion in the second direction in the mated state. The guiding portion is positioned above the contact point and guides the mating contact point towards the contact point upon the mating. The coupling portion couples the first portion with the second portion. The coupling portion is positioned at a position different from a position of the contact point in the first direction.

13 Claims, 16 Drawing Sheets

(51) Int. Cl.

| | |
|---|---|
| ***H01R 12/71*** | (2011.01) |
| ***H01R 12/73*** | (2011.01) |
| *H01R 13/631* | (2006.01) |
| *H01R 13/11* | (2006.01) |
| *H01R 107/00* | (2006.01) |

(56) References Cited

U.S. PATENT DOCUMENTS

| | | | | |
|---|---|---|---|---|
| 5,501,009 | A | 3/1996 | McClure et al. | |
| 6,986,670 | B2 * | 1/2006 | Okura | H01R 13/6275 439/74 |
| 7,568,919 | B2 * | 8/2009 | Hoshino | H01R 12/716 439/74 |
| 7,901,218 | B2 * | 3/2011 | Sato | H01R 13/20 439/74 |
| 7,931,477 | B2 * | 4/2011 | Hirata | H01R 12/716 439/74 |
| 8,485,832 | B2 * | 7/2013 | Mashiyama | H01R 12/716 439/74 |
| 8,556,640 | B2 * | 10/2013 | Mashiyama | H01R 12/73 439/74 |
| 8,888,506 | B2 * | 11/2014 | Nishimura | H01R 12/7082 439/74 |
| 9,124,011 | B2 * | 9/2015 | Miyazaki | H01R 12/716 |
| 9,153,892 | B2 * | 10/2015 | Tanaka | H01R 12/7052 |
| 2007/0275575 | A1 * | 11/2007 | Wang | H01R 13/415 439/74 |
| 2008/0139007 | A1 | 6/2008 | Nagawatari | |
| 2009/0305528 | A1 * | 12/2009 | Hirata | H01R 12/716 439/74 |

FOREIGN PATENT DOCUMENTS

| | | | |
|---|---|---|---|
| JP | 10116642 | A | 5/1998 |
| JP | 2008146888 | A | 6/2008 |
| JP | 2009217943 | A | 9/2009 |
| JP | 2011159507 | A | 8/2011 |
| JP | 2012178248 | A | 9/2012 |

* cited by examiner

CONNECTOR HAVING A TERMINAL WITH A COUPLING PORTION COUPLING A FIRST PORTION HAVING A CONTACT POINT WITH A SECOND PORTION

CROSS REFERENCE TO RELATED APPLICATIONS

An applicant claims priority under 35 U.S.C. §119 of Japanese Patent Application No. JP2014-014459 filed Jan. 29, 2014.

BACKGROUND OF THE INVENTION

This invention relates to a connector which connects objects, such as circuit boards, with each other.

JP 2009-217943 discloses a connector assembly including connectors of the aforementioned type. As shown in FIG. 31, the connector assembly of JP 2009-217943 includes a connector fixed to a circuit board and a mating connector fixed to a mating circuit board. The connector includes a housing and a plurality of terminals held by the housing. The mating connector includes a mating housing and a plurality of mating terminals held by the mating housing. When the connector is mated with the mating connector, the mating terminals are partially inserted into the connector while contact points are connected to mating contact points, respectively.

SUMMARY OF THE INVENTION

It is an object of the present invention to provide a connector which connects objects each other and has a lower profile.

One aspect of the present invention provides a connector which is mateable with a mating connector along an up-down direction. The mating connector includes a plurality of mating terminals each of which has a mating contact point. The connector is mounted to an object when used. The connector comprises a housing and a plurality of terminals. The terminals are, at least in part, accommodated by the housing. The terminals correspond to the mating terminals, respectively. The terminals are arranged in a first direction perpendicular to the up-down direction. Each of the terminals has a first portion, a second portion and a coupling portion. The first portion includes a contact point and a guiding portion. The contact point is positioned apart from the second portion in a second direction perpendicular to both the up-down direction and the first direction. The contact point is in contact with the mating contact point while the mating contact point is positioned between the contact point and the second portion in the second direction when the connector is mated with the mating connector. The guiding portion is positioned above the contact point. The mating contact point is moved downward in the up-down direction and is guided to the contact point by the guiding portion upon the mating of the connector with the mating connector. The second portion is fixed to the object when the connector is used. The coupling portion couples the first portion with the second portion. The coupling portion is positioned at a position different from a position of the contact point in the first direction.

In the first direction, the position of the coupling portion is different from the position of the contact point. In other words, the coupling portion is provided so as not to overlap with an imaginary line which passes the contact point and extends in the second direction. A part of the mating terminal is accommodated in a space which is positioned in front of the contact point in the second direction. In the up-down direction, a size of the space can be secured larger by a size of the coupling portion. In other words, a size of the connector can be lowered by a size of the coupling portion, while the space for accommodating a part of the mating terminal is secured sufficiently.

An appreciation of the objectives of the present invention and a more complete understanding of its structure may be had by studying the following description of the preferred embodiment and by referring to the accompanying drawings.

Figure 1:
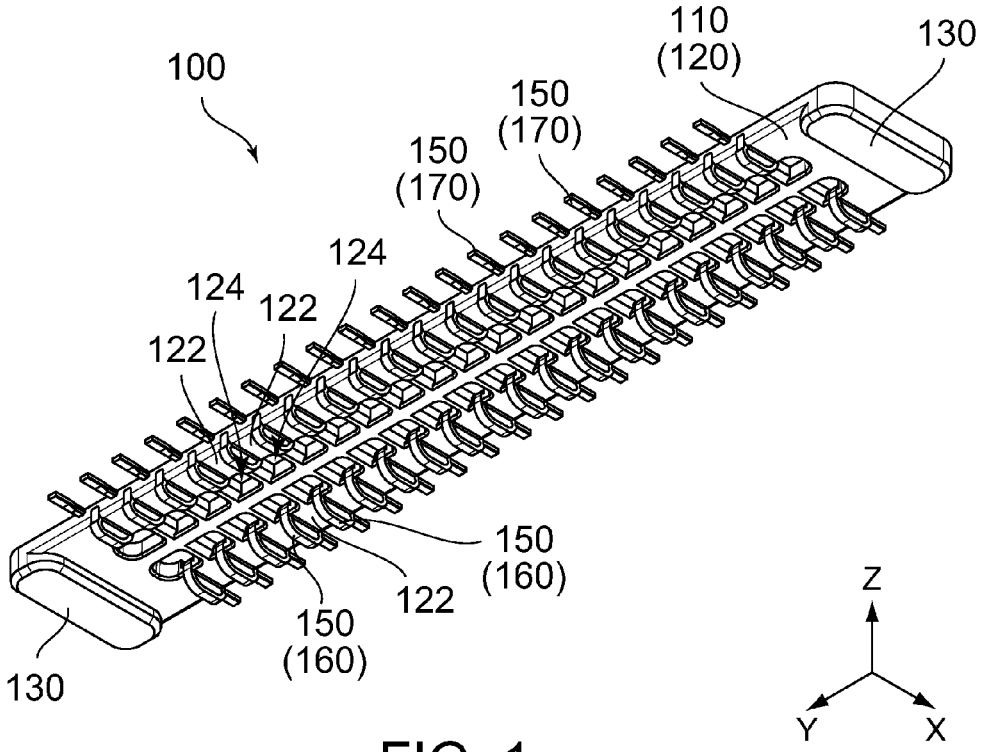
FIG. 1 is a perspective view showing a plug according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS (First Embodiment)

Figure 6:
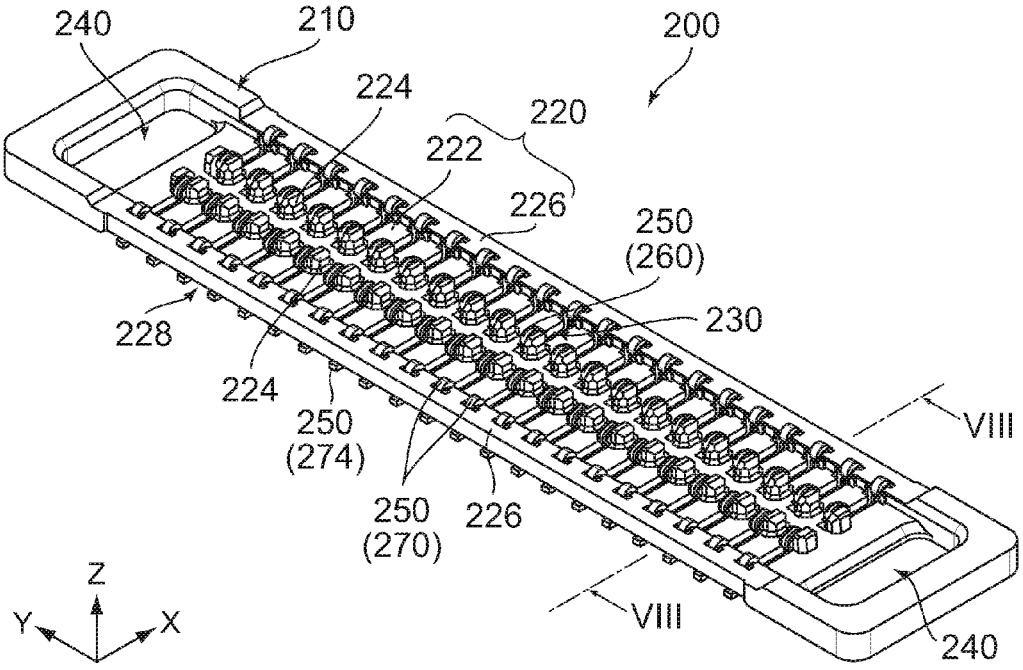
FIG. 6 is a perspective view showing a receptacle according to the first embodiment of the present invention.
Figure 7:
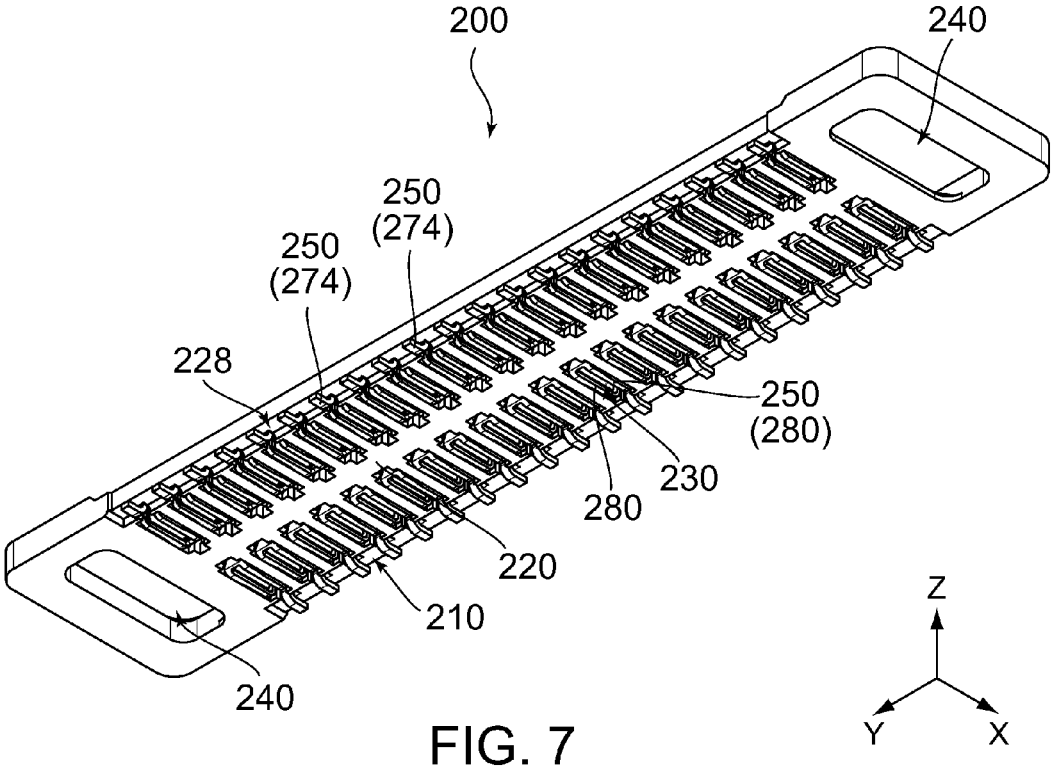
FIG. 7 is another perspective view showing the receptacle of FIG. 6.

A connector assembly according to a first embodiment comprises a plug 100 (mating connector, see FIG. 1) and a receptacle 200 (connector, see FIGS. 6 and 7). The receptacle 200 is mateable with the plug 100 along a Z-direction (up-down direction). Each of the plug 100 and the receptacle 200 of the present embodiment is mounted on an object (not shown) such as a circuit board, a Flexible Printed Circuit (FPC), or the like.

Figure 2:
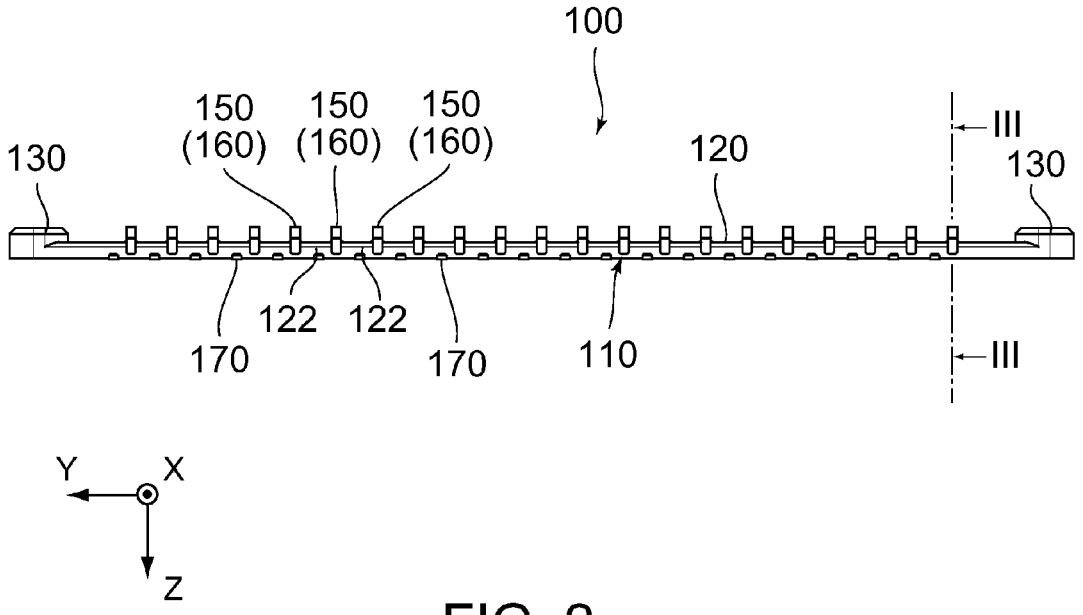
FIG. 2 is a side view showing the plug of FIG. 1.
Figure 3:
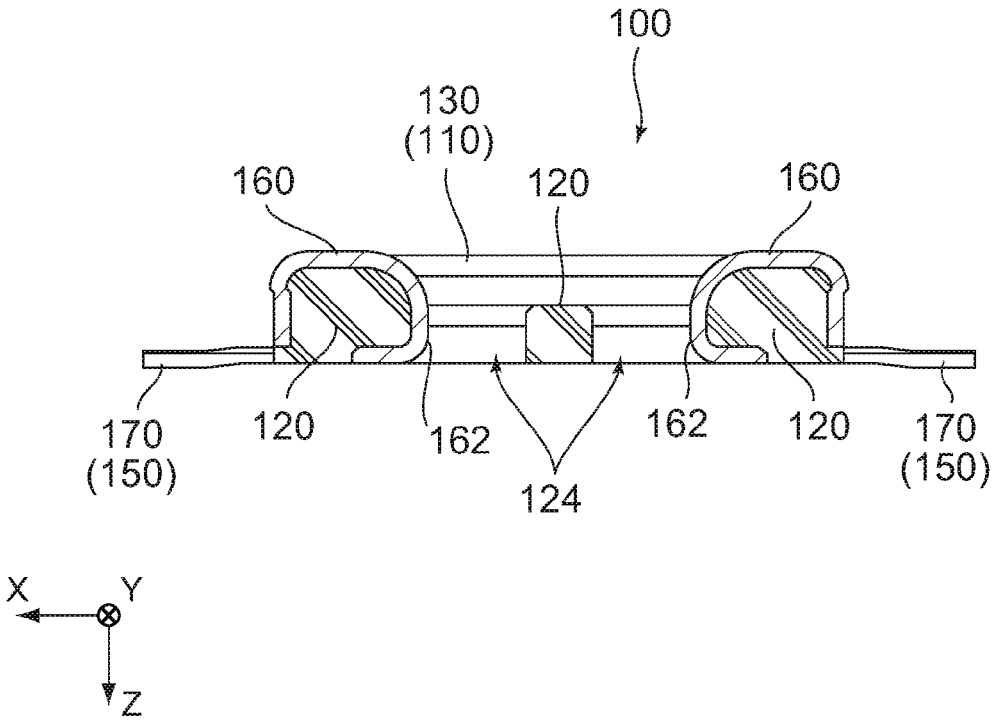
FIG. 3 is a cross-sectional view showing the plug of FIG. 2, taken along line III-III.

With reference to FIGS. 1 to 3, the plug 100 comprises a plug housing (mating housing) 110 and a plurality of plug terminals (mating terminals) 150. The plug housing 110 accommodates, at least in part, the plug terminals 150. The plug housing 110 is made of insulator, and each of the plug terminals 150 is made of conductor. Specifically, the plug housing 110 according to the present embodiment is made of resin, and each of the plug terminals 150 according to the present embodiment is made of metal.

As shown in FIGS. 1 to 3, the plug housing 110 has a plate-like main portion 120 holding the plug terminals 150 and two positioning protrusions 130. The positioning protrusions 130 are provided at opposite ends of the main portion 120 in a Y-direction (first direction), respectively. Each of the positioning protrusions 130 protrudes toward a negative Z-direction in the Z-direction.

The main portion 120 holds the plug terminals 150 which are arranged in two rows. The plug terminals 150 of each row are arranged in the Y-direction. Two rows of the plug terminals 150 are arranged so that one of the rows of the plug terminals 150 is line-symmetrical with the other row of the plug terminals 150 with respect to a line which passes a center of the main portion 120 in an X-direction (second direction) and extends in the Y-direction.

As shown in FIG. 1, the main portion 120 is formed with a plurality of separation portions 122 and a plurality of positioning holes 124. Each of the separation portions 122 is positioned between the plug terminals 150 adjacent to each other in the Y-direction. In other words, the separation portions 122 are positioned alternately with the plug terminals 150 in the Y-direction. As shown in FIG. 1, each of the plug terminals 150 projects toward the negative Z-direction beyond the separation portions 122. In other words, each of the plug terminals 150 projects beyond the separation portions 122 in the Z-direction. The positioning holes 124 correspond to the plug terminals 150, respectively. Each of the positioning holes 124 is positioned inward of the corresponding plug terminal 150 in the X-direction. Each of the plug terminals 150 is at least partly exposed in the corresponding positioning hole 124. Specifically, in the present embodiment, each of the plug terminals 150 is electrically connectable in the corresponding positioning hole 124.

Figure 4:
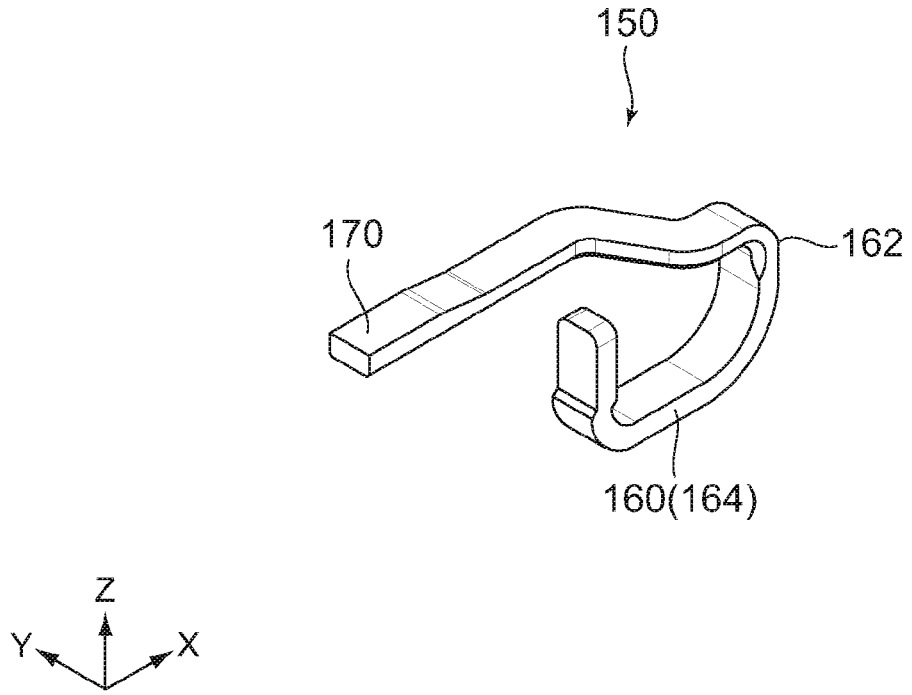
FIG. 4 is a perspective view showing a plug terminal which is included in the plug of FIG. 1.
Figure 5:
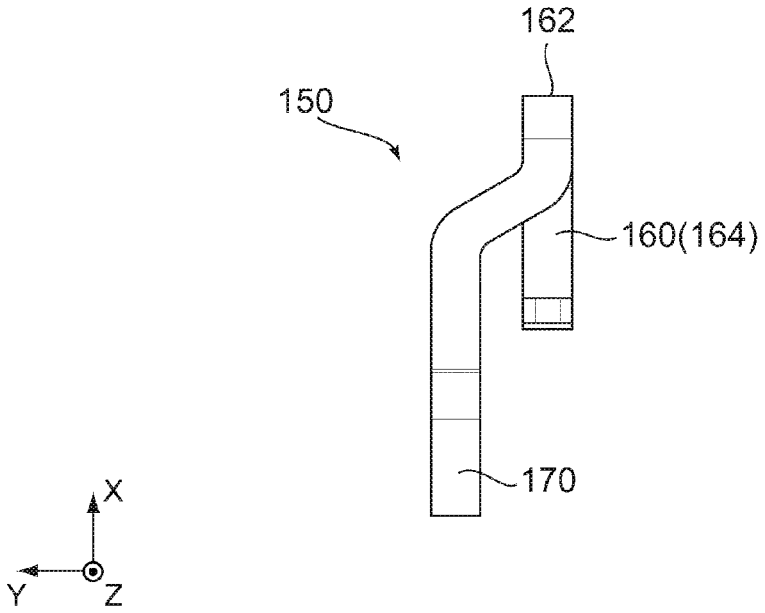
FIG. 5 is a plan view showing the plug terminal of FIG. 4.

As shown in FIGS. 4 and 5, each of the plug terminals 150 has a held portion 160 which has a substantially C-shaped cross-section. Each of the plug terminals 150 includes a fixed portion 170 which is to be fixed to the circuit board (not shown). The held portion 160 is provided with a mating contact point 162. The mating contact point 162 is positioned on an outer surface of the held portion 160. Under a condition where each of the plug terminals 150 is held by the plug housing 110, each of the mating contact points 162 faces the positioning hole 124 corresponding to the plug terminal 150 (see FIG. 3). Specifically, each of the mating contact points 162 is contactable in the corresponding positioning hole 124. As best illustrated in FIG. 5, the mating contact point 162 of the plug terminal 150 of the present embodiment is positioned at a position different in the Y-direction from a position of the fixed portion 170. In other words, the fixed portion 170 is provided so as not to overlap with an imaginary line which passes the mating contact point 162 and extends in the X-direction. As shown in FIG. 1, the plug terminals 150 are held by the main portion 120 of the plug housing 110 so that the fixed portions 170 extend outward in the X-direction, respectively. As understood from FIGS. 1 to 3, the plug terminals 150 according to the present embodiment are installed into the plug housing 110 when the plug housing 110 is formed by an insert-mold process.

Figure 8:
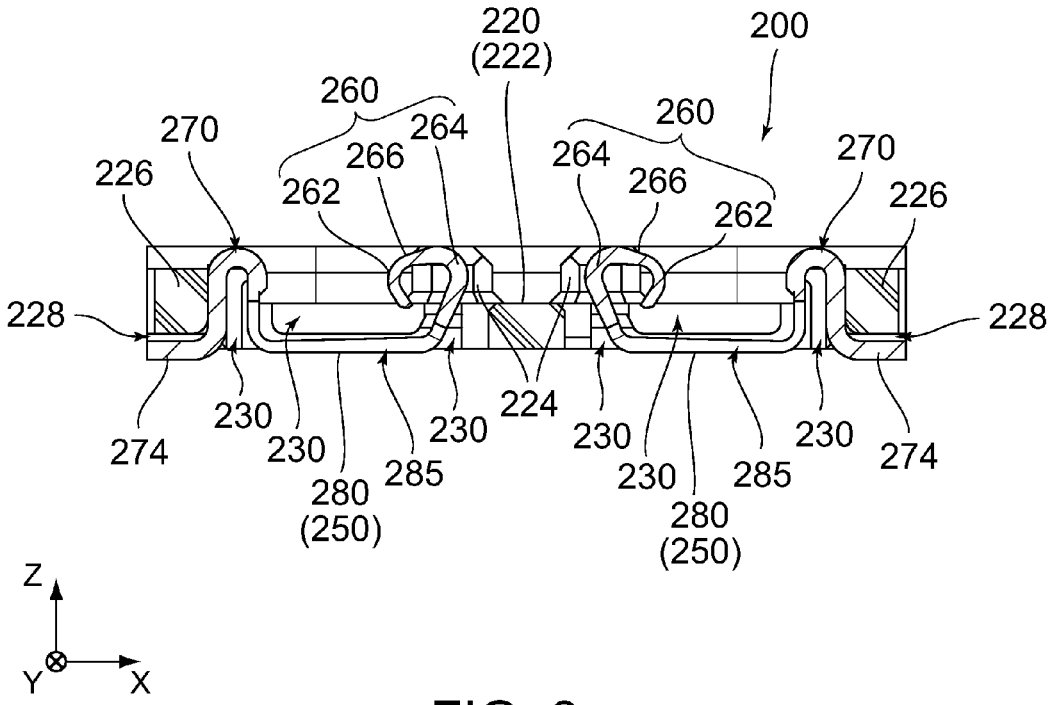
FIG. 8 is a cross-sectional view showing the receptacle of FIG. 6, taken along line VIII-VIII.
Figure 9:
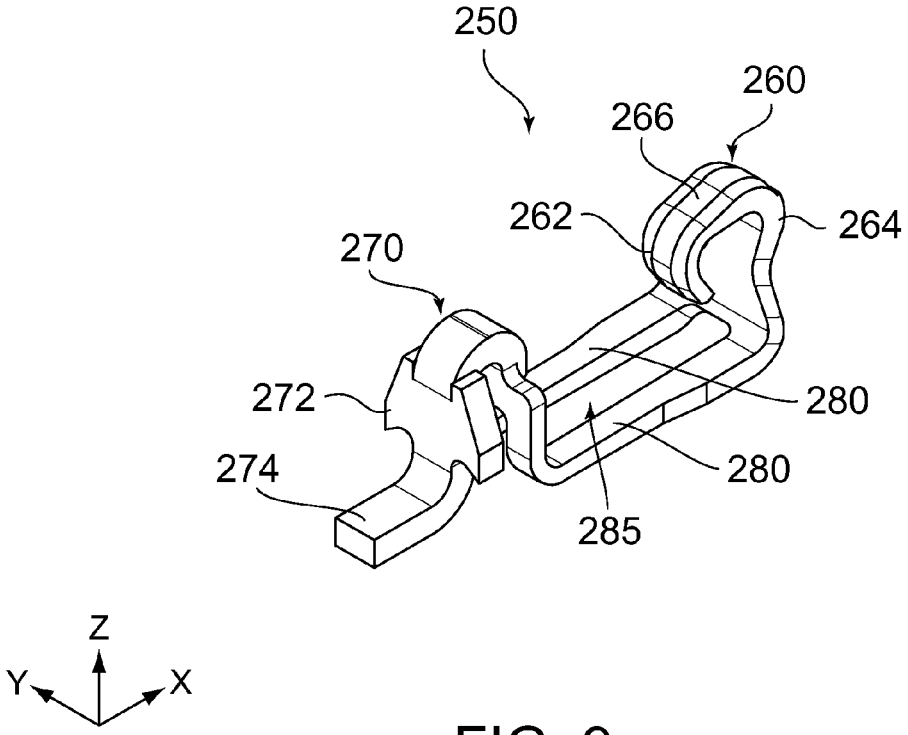
FIG. 9 is a perspective view showing a receptacle terminal which is included in the receptacle of FIG. 6.
Figure 10:
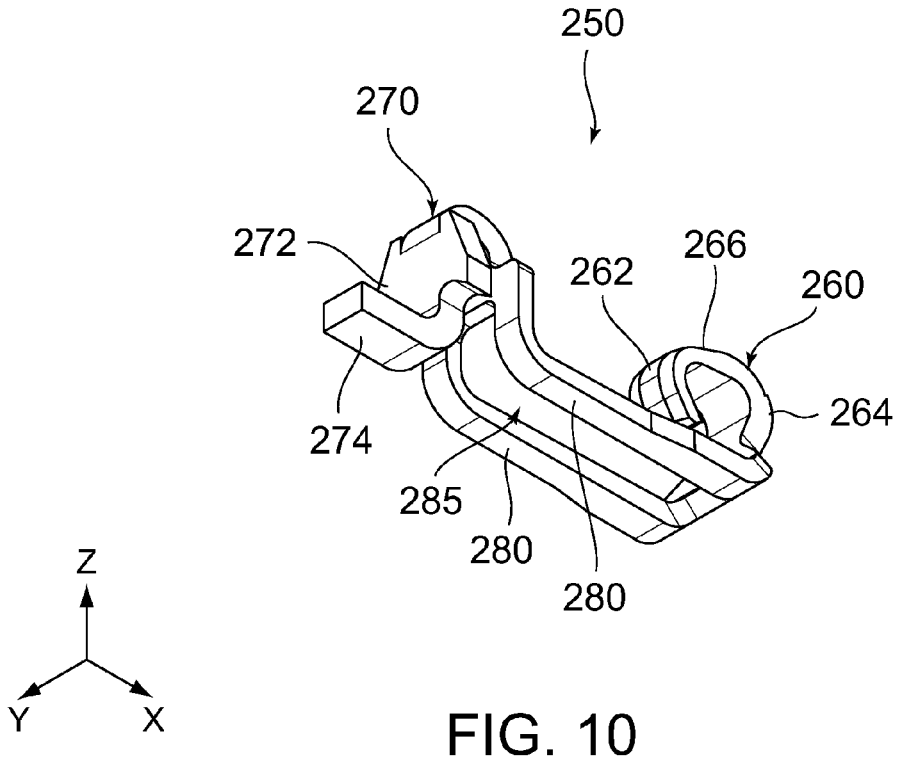
FIG. 10 is another perspective view showing the receptacle terminal of FIG. 9.

With reference to FIGS. 6 to 8, the receptacle 200 comprises a receptacle housing (housing) 210 and a plurality of receptacle terminals (terminals) 250. The receptacle housing 210 accommodates, at least in part, the receptacle terminals 250. The receptacle housing 210 is made of insulator, and each of the receptacle terminals 250 is made of conductor. Specifically, the receptacle housing 210 according to the present embodiment is made of resin, and each of the receptacle terminals 250 according to the present embodiment is made of metal. The receptacle terminals 250 correspond to the plug terminals 150, respectively.

As shown in FIGS. 6 to 8, the receptacle housing 210 has a plate-like main portion 220 and two positioning recesses 240. The main portion 220 holds the receptacle terminals 250. The positioning recesses 240 are provided at opposite ends of the main portion 220 in the Y-direction, respectively. Each of the positioning recesses 240 pierces the receptacle housing 210 in the Z-direction. The positioning recesses 240 correspond to the above-described positioning protrusions 130 (see FIG. 1), respectively. Each of the positioning recesses 240 receives the corresponding positioning protrusion 130 when the receptacle 200 is mated with the plug 100. In addition, provided that each of the positioning recesses 240 is receivable the corresponding positioning protrusion 130, each of the positioning recesses 240 may not pierce the receptacle housing 210.

The main portion 220 has a thin plate portion 222 and side portions 226. The side portions 226 are positioned at opposite ends of the thin plate portion 222 in the X-direction, respectively. The thin plate portion 222 is positioned at a center of the main portion 220. The thin plate portion 222 is provided with a plurality of positioning projections 224. Each of the positioning projections 224 projects toward a positive Z-direction. The positioning projections 224 correspond to the positioning holes 124 (see FIG. 1) of the plug housing 110, respectively. When the receptacle 200 is mated with the plug 100, each of the positioning projections 224 is received in the corresponding positioning hole 124 together with a part of the receptacle terminal 250 as described later.

The main portion 220 according to the present embodiment has two of the side portions 226. Each of the two side portions 226 has a square bar-like shape and extends in the Y-direction. As shown in FIGS. 7 and 8, each of bottom surfaces (negative Z-side surfaces) of the side portions 226 is positioned upward (toward a positive Z-side) of a bottom surface (negative Z-side surface) of the thin plate portion 222. Accordingly, spaces 228 are formed downward (toward the negative Z-side) of the side portions 226, respectively. In the present embodiment, each of upper surfaces (positive Z-side surfaces) of the side portions 226 is positioned upward (toward the positive Z-side) of an upper surface (positive Z-side surface) of the thin plate portion 222. Specifically, when the receptacle 200 is viewed from upward (toward the positive Z-side), the thin plate portion 222 is recessed with respect to the side portions 226. In other words, a recess is formed by the thin plate portion 222A and the side portions 226A. When the receptacle 200 is mated with the plug 100 (see FIG. 1), the recess receives the main portion 120 of the plug 100. In other words, under a condition where the receptacle 200 is mated with the plug 100, the main portion 120 of the plug 100 is positioned between the side portions 226 of the receptacle 200 in the X-direction.

The main portion 220 is formed with a plurality of receiving portions 230 which extend over from the thin plate portion 222 to the side portion 226. The receiving portions 230 correspond to the receptacle terminals 250, respectively. Each of the receiving portions 230 receives a part of the corresponding receptacle terminal 250.

As shown in FIGS. 8 to 11, each of the receptacle terminals 250 has a first portion 260, a second portion 270 and coupling portions 280 each of which couples the first portion 260 with the second portion 270.

The first portion 260 includes a contact point 262 and a supporting portion 264 which has a resilient characteristic and supports the contact point 262. The supporting portion 264 supports the contact point 262 so that the contact point 262 is movable at least in the X-direction. The contact point 262 is positioned apart from the second portion 270 in the X-direction and faces toward the second portion 270 (toward the negative X-side of the receptacle terminal 250 shown in FIG. 9). A part of the supporting portion 264 is provided with a guiding portion 266 which has a plane intersecting both the Z-direction and the X-direction. In other words, the guiding portion 266 is formed as a part of the supporting portion 264. The guiding portion 266 is positioned toward the positive Z-side (upward) of the contact point 262. When the receptacle 200 is mated with the plug 100 (see FIG. 3), each of the guiding portions 266 guides the mating contact point 162 of the corresponding plug terminal 150 which is moved relative to the receptacle 200 toward the negative Z-direction (downward), so that each of the contact points 262 is connected to the mating contact point 162 of the corresponding plug terminal 150. In the present embodiment, an end of the first portion 260 far from the contact point 262 is branched into two sections.

The second portion 270 has a press-fitted portion 272 and a mounted portion 274. Each of the press-fitted portions 272 is press-fitted into the receptacle housing 210. Each of the mounted portions 274 is mounted and fixed to the circuit board (not shown) as the object by soldering. In the present embodiment, an end of the second portion 270 far from the mounted portion 274 is branched into two sections.

Figure 11:
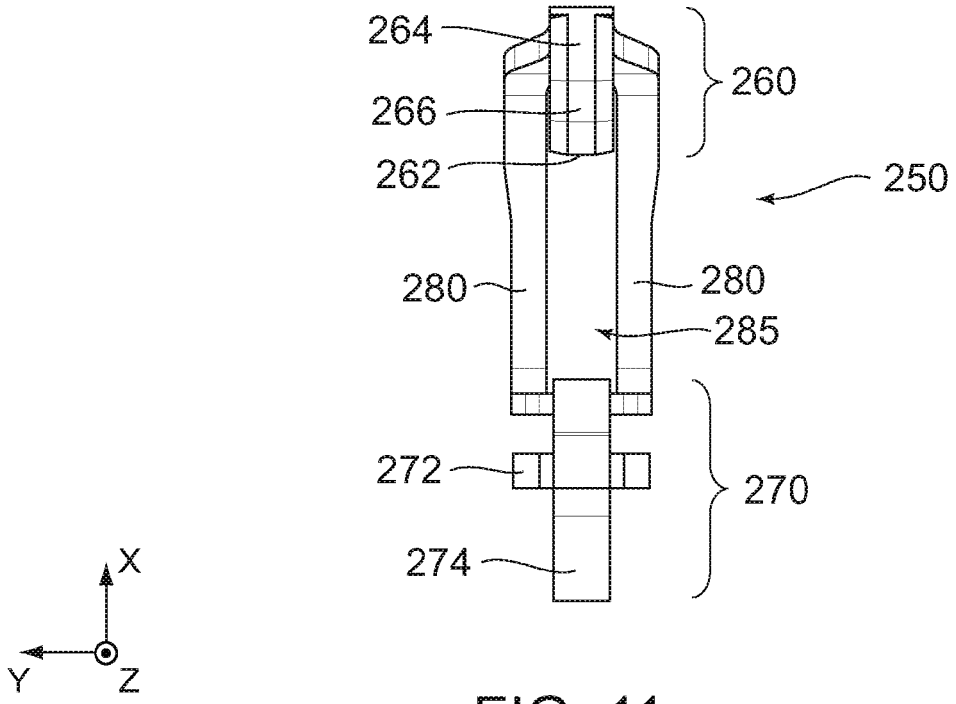
FIG. 11 is a plan view showing the receptacle terminal of FIG. 9.
Figure 12:
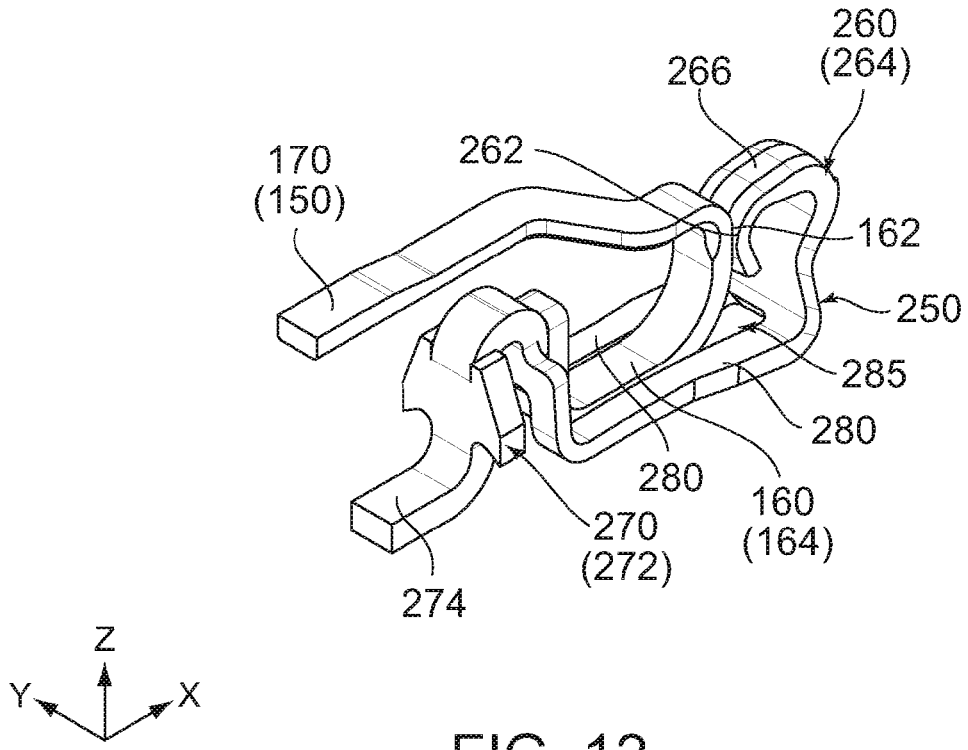
FIG. 12 is a perspective view showing a connection state of the plug terminal of FIG. 4 and the receptacle terminal of FIG. 9.
Figure 13:
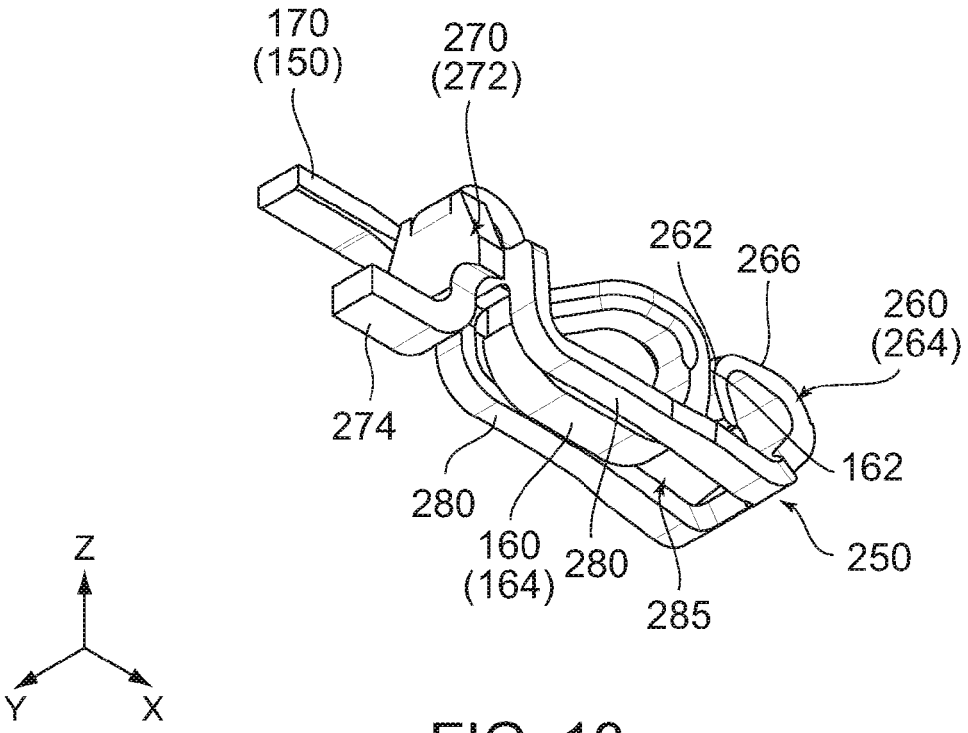
FIG. 13 is another perspective view showing the connection state of the plug terminal of FIG. 4 and the receptacle terminal of FIG. 9.

As best illustrated in FIG. 11, in the present embodiment, the first portion 260 is positioned at a position same as a position of the second portion 270 in the Y-direction. In detail, the contact point 262 is positioned at a position same as a position of the mounted portion 274 in the Y-direction. Especially, a center of the contact point 262 in the Y-direction is aligned with a center of the mounted portion 274 in the Y-direction.

In the present embodiment, each of the receptacle terminals 250 has two of the coupling portions 280. The two coupling portions 280 couple the two sections of the first portion 260 with the two sections of the second portion 270, respectively. Accordingly, the coupling portions 280, the first portion 260 and the second portion 270 form an allowable region 285. The allowable region 285 of the present embodiment has a liner shape extending in the X-direction on an XY-plane. As described later, under the condition where the receptacle 200 (see FIG. 8) is mated with the plug 100 (see FIG. 3), received parts 164 of the plug terminals 150 are received in the allowable regions 285, respectively, so that the allowable regions 285 allow the received parts 164 of the plug terminals 150 to be positioned at positions same as positions of the coupling portions 280 in the Z-direction, respectively.

As best illustrated in FIG. 11, the coupling portion 280 is positioned at a position different from a position of the contact point 262 in the Y-direction. In other words, the coupling portion 280 is provided so as not to overlap with an imaginary line which passes the contact point 262 and extends in the X-direction.

As understood from FIGS. 6 to 8, under a condition where each of the receiving portions 230 receives the part of the corresponding receptacle terminal 250 while each of the press-fitted portions 272 is press-fitted into the side portion 226 of the main portion 220 of the receptacle housing 210, the contact points 262 and the guiding portions 266 are arranged adjacent to the positioning projections 224 in the Y-direction, respectively. When the receptacle 200 is mated with the plug 100, the contact points 262, the guiding portions 266 and the corresponding positioning projections 224 are inserted into the positioning holes 124, respectively. Accordingly, each of the held portions 160 of the plug terminals 150 is sandwiched between the first portion 260 and the second portion 270 of the corresponding receptacle terminal 250 while each of the mating contact points 162 of the plug terminals 150 is in contact with the contact point 262 of the corresponding receptacle terminal 250 in the corresponding positioning hole 124. Specifically, under the condition where the receptacle 200 is mated with the plug 100, each of the mating contact points 162 of the plug terminals 150 is positioned between the contact point 262 and the second portion 270 of the corresponding receptacle terminal 250 in the X-direction while each of the mating contact points 162 of the plug terminals 150 is in contact with the contact point 262 of the corresponding receptacle terminal 250.

As shown in FIGS. 6 to 8, under a condition where the receptacle terminals 250 are held by the receptacle housing 210, each of the mounted portions 274 is positioned within the space 228. Specifically, each of the mounted portions 274 is positioned downward (toward the negative Z-side) of the side portion 226. As understood from FIG. 8, under the condition where the receptacle terminals 250 are held by the receptacle housing 210, each of the coupling portions 280 is positioned slightly upward (toward the positive Z-side) of the mounted portion 274. Accordingly, each of the coupling portions 280 is deformable while the first portion 260 is movable in the Z-direction. In other words, each of the coupling portions 280 supports the first portion 260 so that the first portion 260 is movable at least in the Z-direction. However, the present invention is not limited thereto. The mounted portion 274 and the coupling portion 280 may be arranged on a common XY-plane. In other words, when the receptacle 200 is mounted on the circuit board (not shown) while each of the mounted portions 274 are fixed on the circuit board, each of the coupling portions 280 may be in contact with the circuit board.

As shown in FIGS. 6 and 8, in the present embodiment, each of the second portions 270 of the receptacle terminals 250 projects toward the positive Z-side (upward) from the side portion 226. In other words, an area is provided between every neighboring second portions 270 in the Y-direction and above the side portion 226.

As best illustrated in FIG. 11, the allowable region 285 is formed between the contact point 262 and the second portion 270, and the coupling portion 280 is not formed therebetween. In other words, the allowable regions 285 are formed next to the coupling portions 280, respectively, in the Y-direction. As understood from FIGS. 12 to 15, when the receptacle terminals 250 are in contact with the plug terminals 150, respectively (i.e. when the receptacle 200 is mated with the plug 100), received parts 164 of the plug terminals 150 are received in the allowable regions 285, respectively, while the received parts 164 of the plug terminal 150 are positioned at positions same as positions of the coupling portions 280, respectively, in the Z-direction. Accordingly, a height of the held portion 160 can be increased (i.e. a size of the held portion 160 in the Z-direction can be increased), so that a distance (i.e. contact effective length) by which the contact point 262 is relatively slid on the plug terminal 150 can be increased. In other words, in the present embodiment, heights of the receptacle 200 and the plug 100 can be decreased while sufficient contact effective length can be ensured.

Figure 14:
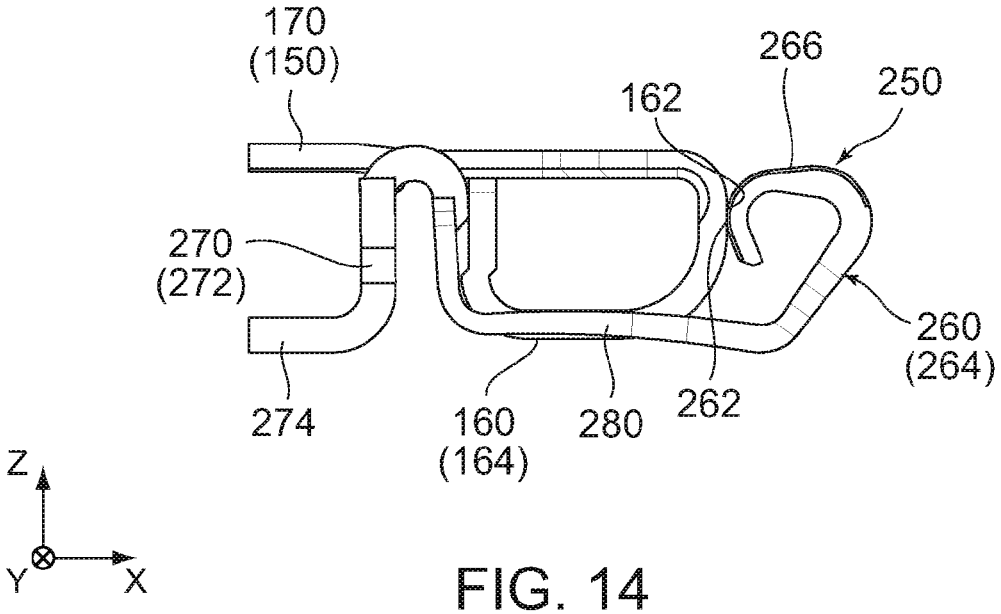
FIG. 14 is a side view showing the connection state of the plug terminal of FIG. 4 and the receptacle terminal of FIG. 9.
Figure 15:
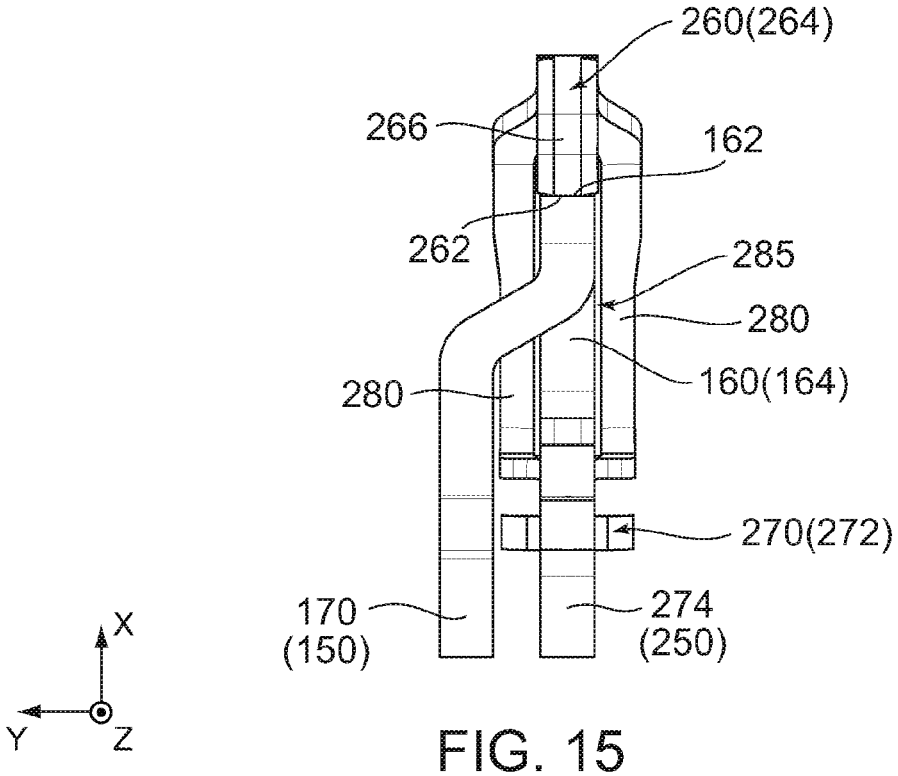
FIG. 15 is a plan view showing the connection state of the plug terminal of FIG. 4 and the receptacle terminal of FIG. 9.

Especially, as understood from FIG. 15, the fixed portion 170 and the mounted portion 274 are positioned at positions different in the Y-direction from each other. Specifically, under the condition where the receptacle 200 is mated with the plug 100, from a perspective plan view of the connector assembly from above (positive Z-side), it is understood that the fixed portion 170 and the mounted portion 274 are provided so as not to overlap with each other. Since the area is provided between every neighboring second portions 270 in the Y-direction and above the side portion 226, as described above, each of the fixed portions 170 can be positioned at the area. Accordingly, as shown in FIG. 14, under the condition where the receptacle 200 is mated with the plug 100, the fixed portion 170 and a part of the second portion 270 can be positioned to align in the Y-direction. In other words, the fixed portion 170 can be positioned to overlap with a part of the second portion 270 in the Z-direction. Thus, according to the present embodiment, under the condition where the receptacle 200 is mated with the plug 100, a size of the connector assembly in the Z-direction can be reduced.

Although the mounted portion 274 is positioned at a position same as a position of the contact point 262 in the present embodiment, the present invention is not limited thereto. For example, the mounted portion 274 may be positioned at a position same as a position of one of the coupling portions 280 in the Y-direction.

(Second Embodiment)

Figure 21:
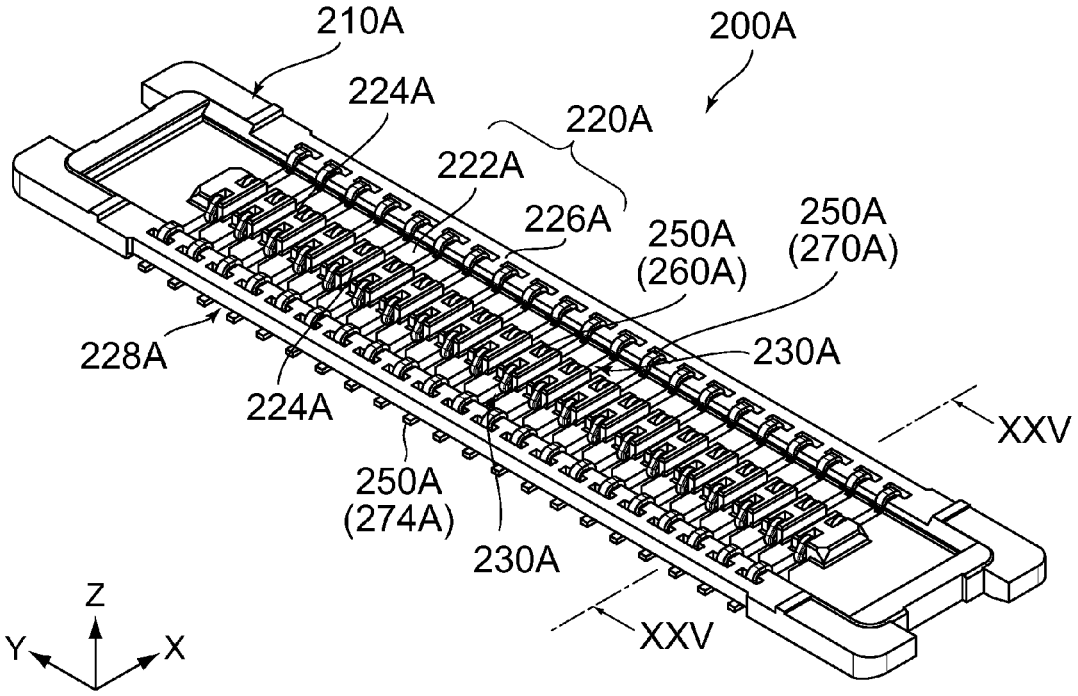
FIG. 21 is a perspective view showing a receptacle according to the second embodiment of the present invention.
Figure 22:
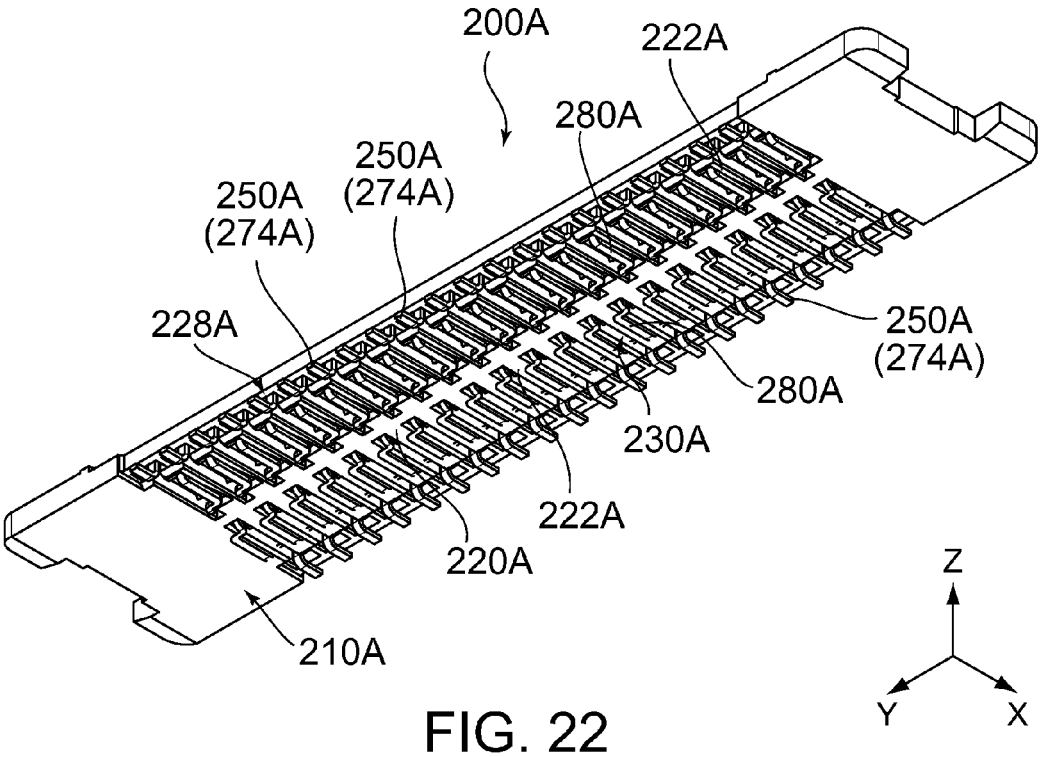
FIG. 22 is another perspective view showing the receptacle of FIG. 21.

A connector assembly according to a second embodiment comprises a plug 100A (mating connector, see FIG. 16) and a receptacle 200A (connector, see FIGS. 21 and 22). The receptacle 200A is mateable with the plug 100A along the Z-direction (up-down direction). Similar to the connector assembly of the first embodiment as described above, each of the plug 100A and the receptacle 200A of the present embodiment is mounted on the object (not shown) such as the circuit board, the Flexible Printed Circuit (FPC), or the like.

Figure 16:
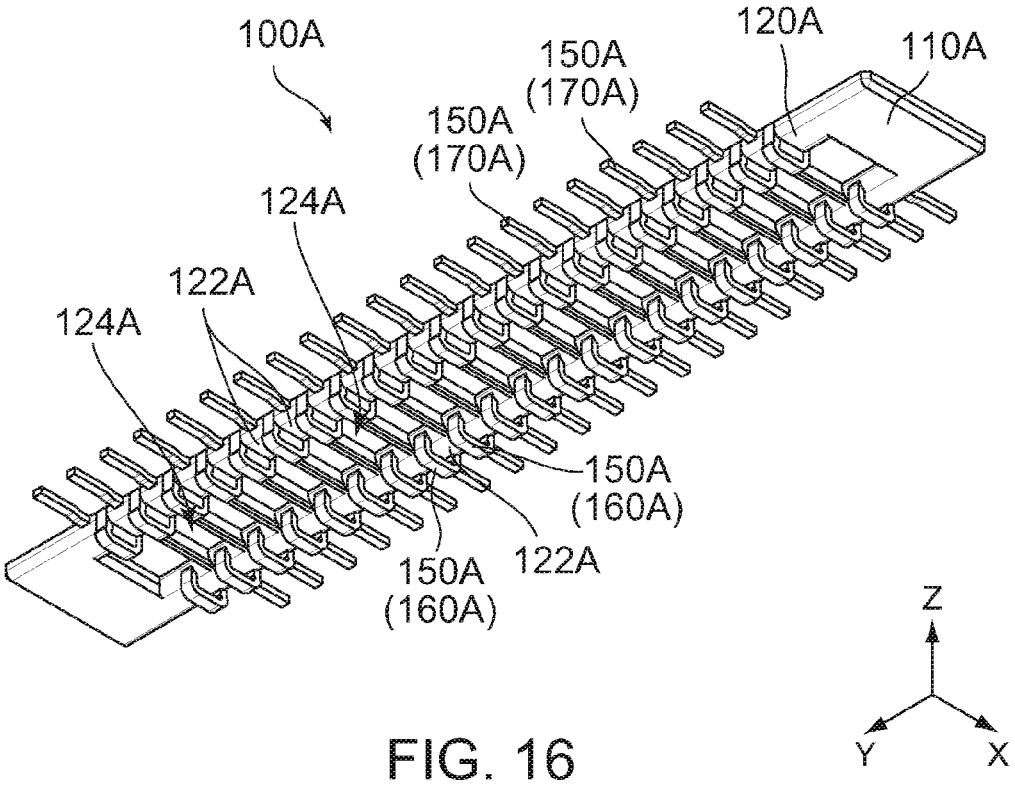
FIG. 16 is a perspective view showing a plug according to a second embodiment of the present invention.
Figure 17:
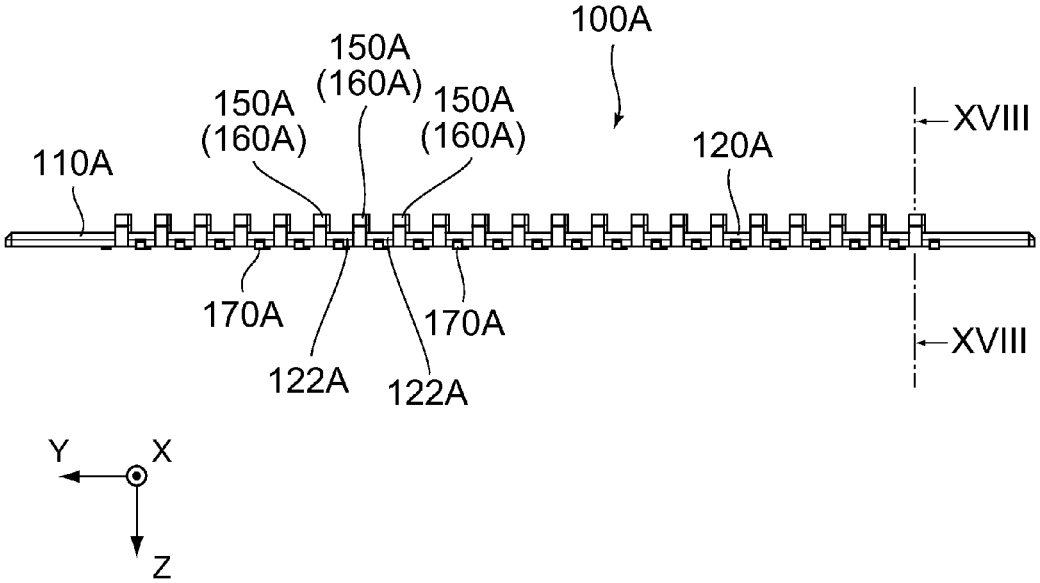
FIG. 17 is a side view showing the plug of FIG. 16.
Figure 18:
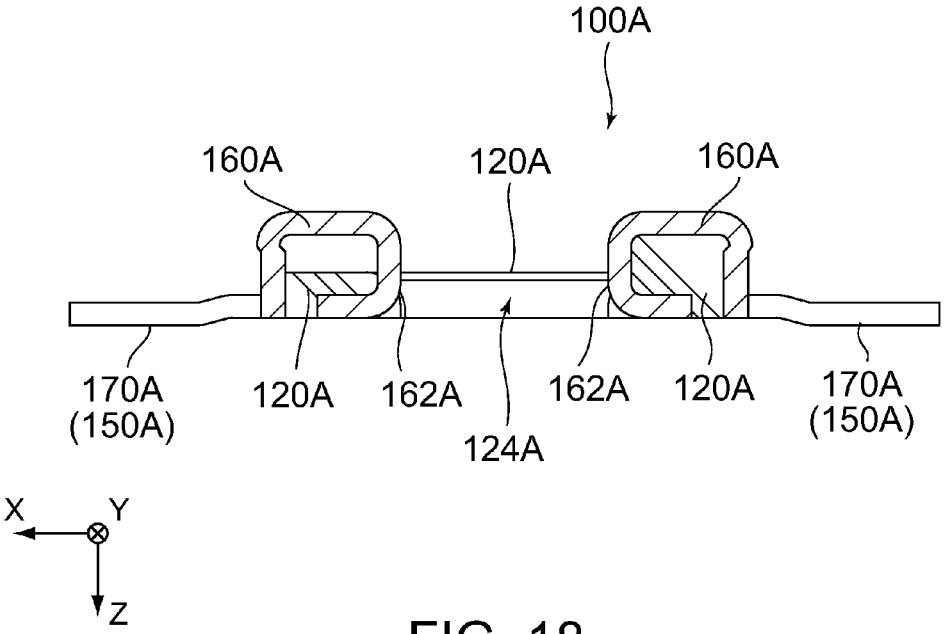
FIG. 18 is a cross-sectional view showing the plug of FIG. 17, taken along line XVIII-XVIII.

With reference to FIGS. 16 to 18, the plug 100A comprises a plug housing (mating housing) 110A and a plurality of plug terminals (mating terminals) 150A. The plug housing 110A accommodates, at least in part, the plug terminals 150A. The plug housing 110 A is made of insulator, and each of the plug terminals 150A is made of conductor. Specifically, the plug housing 110A according to the present embodiment is made of resin, and each of the plug terminals 150A according to the present embodiment is made of metal.

As shown in FIGS. 16 to 18, the plug housing 110A has a plate-like main portion 120A holding the plug terminals 150A.

The main portion 120A holds the plug terminals 150A which are arranged in two rows. The plug terminals 150 of each row are arranged in the Y-direction. The plug terminals 150A of one row correspond to the plug terminals 150A of the other row, respectively, in the X-direction (second direction). Each one of the plug terminals 150A of the one row and a corresponding one of the plug terminals 150A of the other row are provided so as to be point-symmetrical with each other with respect to a point equidistant from their positions.

As shown in FIG. 16, the main portion 120A is formed with a plurality of separation portions 122A and a plurality of positioning holes 124A. Each of the separation portions 122A is positioned between the plug terminals 150A adjacent to each other in the Y-direction. In other words, the separation portions 122A are positioned alternately with the plug terminals 150A in the Y-direction. As shown in FIG. 17, each of the plug terminals 150A projects toward the negative Z-direction beyond the separation portions 122A. In other words, each of the plug terminals 150A projects beyond the separation portions 122A in the Z-direction. Unlike the first embodiment, the positioning holes 124A are provided as holes common to both the plug terminals 150A of the one row and the corresponding plug terminals 150A of the other row in the X-direction, respectively. Accordingly, a total number of the positioning holes 124A is half of a total number of the plug terminals 150A. Each of the positioning holes 124A is positioned between the two corresponding plug terminals 150A. Each of the plug terminals 150A is at least partly exposed in the corresponding positioning hole 124A. Specifically, in the present embodiment, each of the plug terminals 150A is electrically connectable in the corresponding positioning hole 124A.

Figure 19:
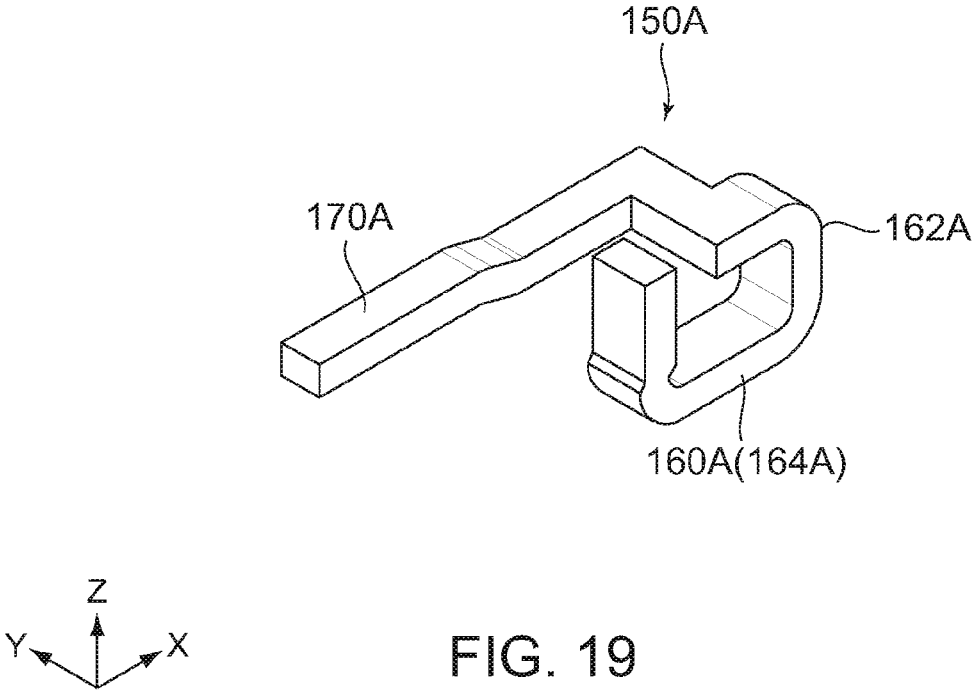
FIG. 19 is a perspective view showing a plug terminal which is included in the plug of FIG. 16.
Figure 20:
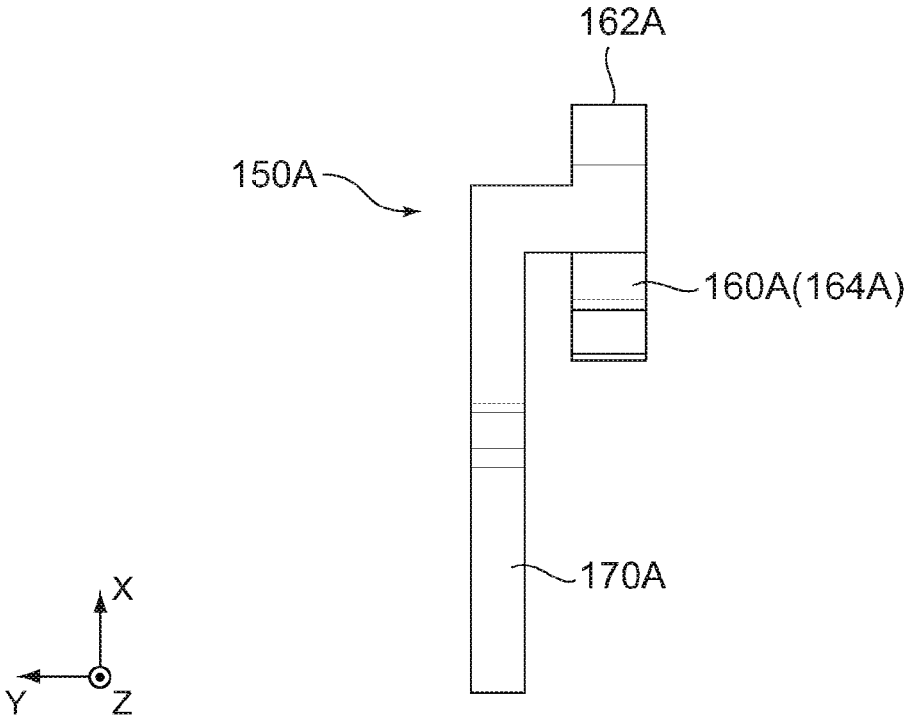
FIG. 20 is a plan view showing the plug terminal of FIG. 19.

As shown in FIGS. 19 and 20, each of the plug terminals 150A has a held portion 160A which has a substantially C-shaped cross-section. Each of the plug terminals 150A includes a fixed portion 170A which is fixed to the circuit board (not shown). The held portion 160A is provided with a mating contact point 162A. The mating contact point 162A is positioned on an outer surface of the held portion 160A. Under a condition where each of the plug terminals 150A is held by the plug housing 110A, each of the mating contact points 162A is exposed within the positioning hole 124 corresponding to the plug terminal 150A (see FIG. 18). Specifically, each of the mating contact points 162A is contactable in the corresponding positioning hole 124. As best illustrated in FIG. 20, the mating contact point 162A of the plug terminal 150A of the present embodiment is positioned at a position different in the Y-direction from a position of the fixed portion 170A. In other words, the fixed portion 170A is provided so as not to overlap with an imaginary line which passes the mating contact point 162A and extends in the X-direction. As shown in FIG. 16, the plug terminals 150A are held by the main portion 120A of the plug housing 110A so that the fixed portions 170A extend outward in the X-direction, respectively. As understood from FIGS. 16 and 17, the plug terminals 150A according to the present embodiment are installed into the plug housing 110A when the plug housing 110A is formed by an insert-mold process.

Figure 23:
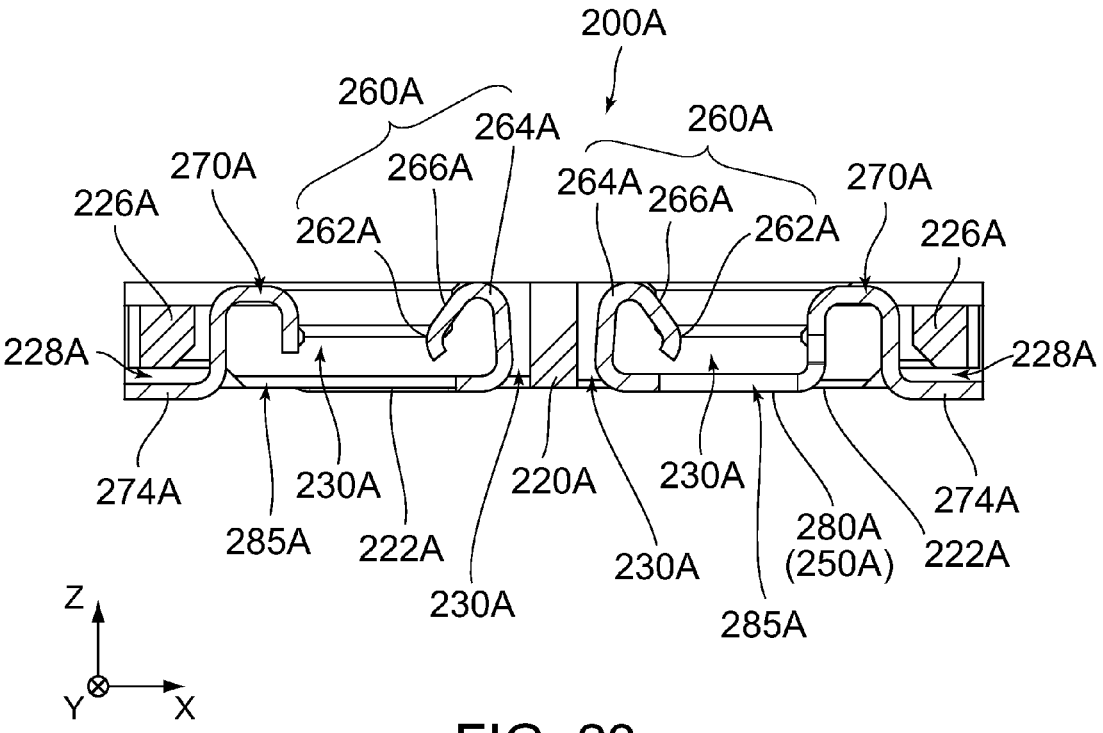
FIG. 23 is a cross-sectional view showing the receptacle of FIG. 21, taken along line XXV-XXV.

With reference to FIGS. 21 to 23, the receptacle 200A comprises a receptacle housing (housing) 210A and a plurality of receptacle terminals (terminals) 250A. The receptacle housing 210A accommodates, at least in part, the receptacle terminals 250A. The receptacle housing 210A is made of insulator, and each of the receptacle terminals 250A is made of conductor. Specifically, the receptacle housing 210A according to the present embodiment is made of resin, and each of the receptacle terminals 250A according to the present embodiment is made of metal. The receptacle terminals 250A correspond to the plug terminals 150A, respectively.

As shown in FIGS. 21 to 23, the receptacle housing 210A has a plate-like main portion 220A holding the receptacle terminals 250A. The main portion 220A has a thin plate portion 222A and side portions 226A. The side portions 226A are positioned at opposite ends of the thin plate portion 222A in the X-direction, respectively. The thin plate portion 222A is positioned at a center of the main portion 220A. The thin plate portion 222A is provided with a plurality of positioning projections 224A. Each of the positioning projections 224A projects toward the positive Z-direction. When the receptacle 200A is viewed from above (the positive Z-side), each of the positioning projections 224A according to the present embodiment has an H-like shape. Specifically, each of the positioning projections 224A has two ditches which are recessed inward along the X-direction. The positioning projections 224A correspond to the positioning holes 124A (see FIG. 18) of the plug housing 110A, respectively. In other words, a total number of the positioning projections 224A is half of a total number of the receptacle terminals 250A. When the receptacle 200A is mated with the plug 100A, each of the positioning projections 224A is received in the corresponding positioning hole 124A together with a part of the receptacle terminal 250A as described later.

The main portion 220A according to the present embodiment has two of the side portions 226A. Each of the two side portions 226A has a square bar-like shape and extends in the Y-direction. As shown in FIGS. 22 and 23, each of bottom surfaces (negative Z-side surfaces) of the side portions 226A is positioned upward (toward the positive Z-side) of a bottom surface (negative Z-side surface) of the thin plate portion 222A. Accordingly, spaces 228A are formed downward (toward the negative Z-side) of the side portions 226A, respectively. In the present embodiment, each of upper surfaces (positive Z-side surfaces) of the side portions 226A is positioned upward (toward the positive Z-side) of an upper surface (positive Z-side surface) of the thin plate portion 222A. Specifically, when the receptacle 200A is viewed from upward (positive Z-side), the thin plate portion 222A is recessed with respect to the side portions 226A. In other words, a recess is formed by the thin plate portion 222A and the side portions 226A. When the receptacle 200A is mated with the plug 100A (see FIG. 18), the recess receives the main portion 120A of the plug 100A. In other words, under a condition where the receptacle 200A is mated with the plug 100A, the main portion 120A of the plug 100A is positioned between the side portions 226A in the X-direction.

The main portion 220A is formed with a plurality of receiving portions 230A which extend over from the thin plate portion 222A to the side portion 226A. The receiving portions 230A according to the present embodiment include the aforementioned ditches which are formed on the positioning projections 224A, respectively. The receiving portions 230A correspond to the receptacle terminals 250A, respectively. Each of parts of the receiving portions 230A receives the corresponding receptacle terminal 250A. Meanwhile, each of parts of the receptacle terminals 250A is positioned in the corresponding ditch formed on the positioning projection 224A.

As shown in FIGS. 23 to 26, each of the receptacle terminals 250A has a first portion 260A, a second portion 270A and a coupling portion 280A which couples the first portion 260A with the second portion 270A.

Figure 24:
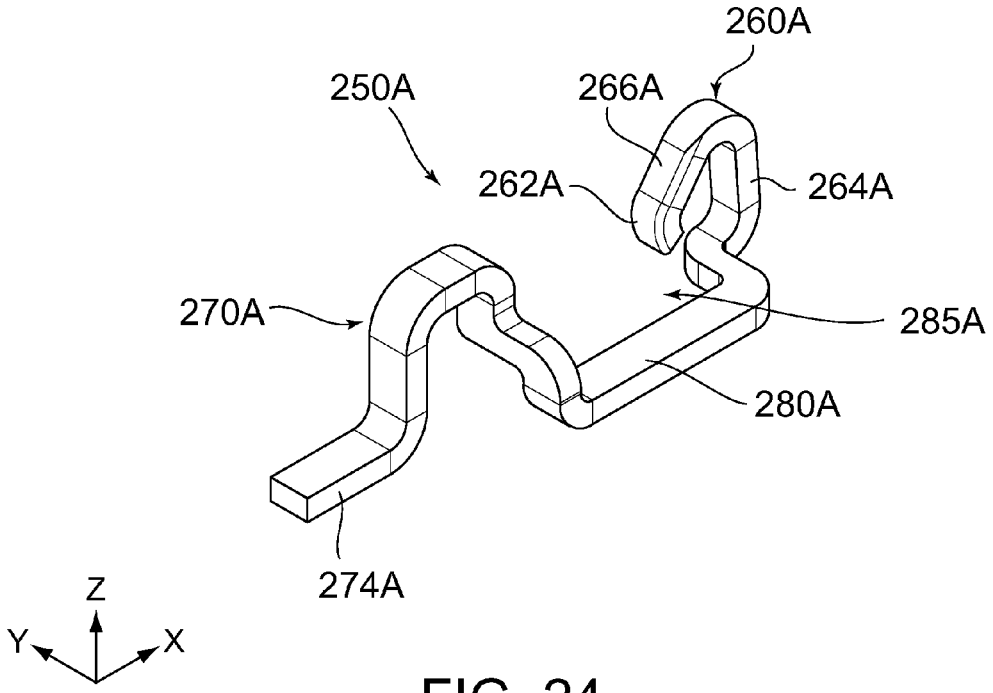
FIG. 24 is a perspective view showing a receptacle terminal which is included in the receptacle of FIG. 21.
Figure 25:
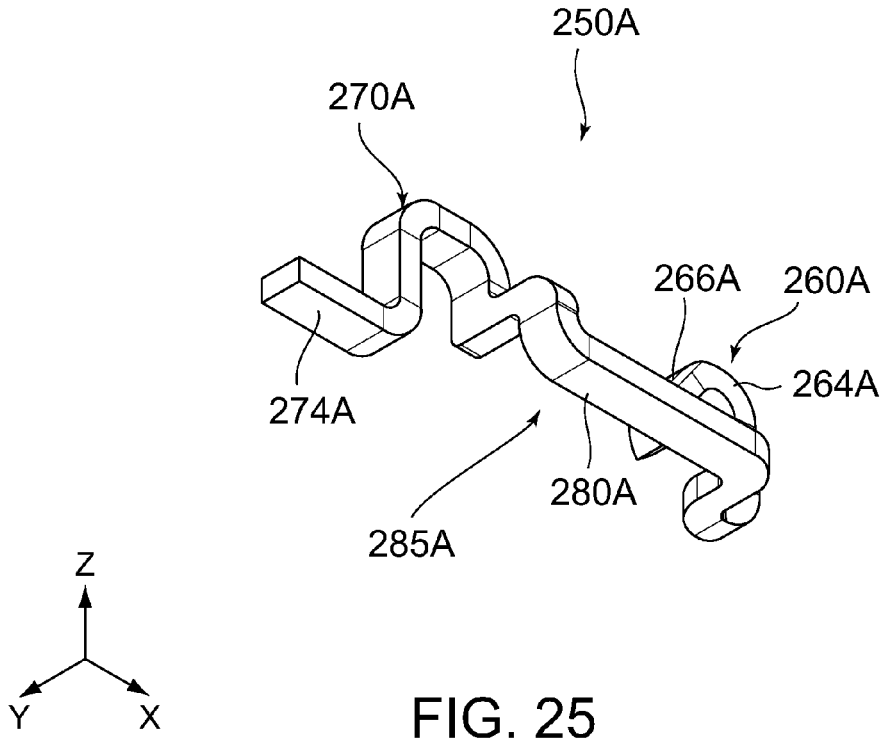
FIG. 25 is another perspective view showing the receptacle terminal of FIG. 24.
Figure 26:
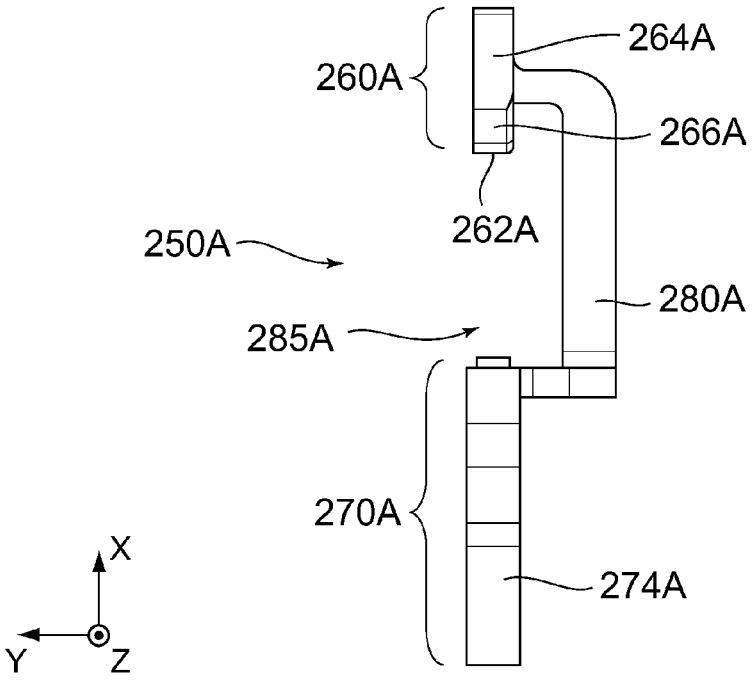
FIG. 26 is a plan view showing the receptacle terminal of FIG. 24.
Figure 27:
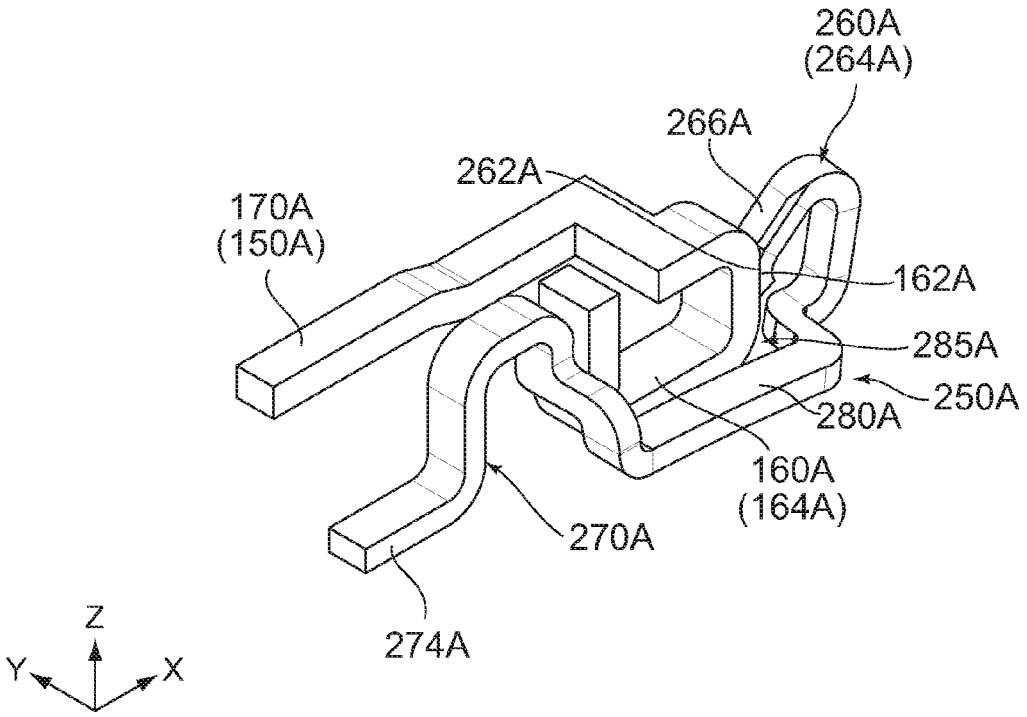
FIG. 27 is a perspective view showing a connection state of the plug terminal of FIG. 19 and the receptacle terminal of FIG. 24.
Figure 28:
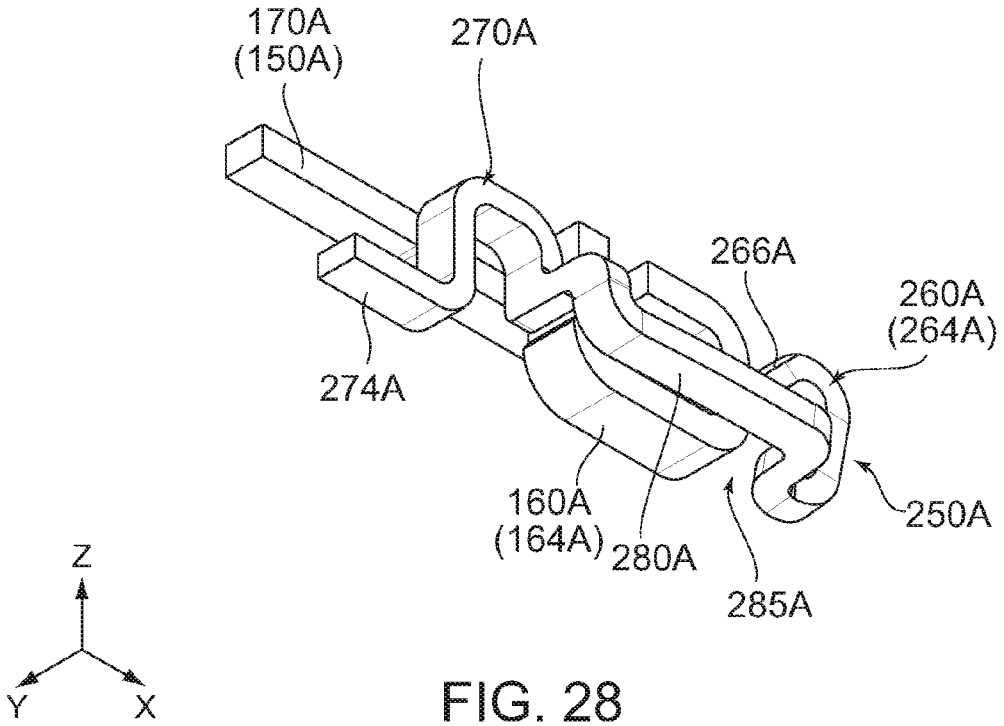
FIG. 28 is another perspective view showing the connection state of the plug terminal of FIG. 19 and the receptacle terminal of FIG. 24.

As shown in FIGS. 23 to 26, the first portion 260A includes a contact point 262A and a supporting portion 264A which has a resilient characteristic and supports the contact point 262A. The supporting portion 264A supports the contact point 262 so that the contact point 262A is movable at least in the X-direction. The contact point 262A is positioned apart from the second portion 270A in the X-direction and faces toward the second portion 270A (toward the negative X-side of the receptacle terminal 250A shown in FIG. 24). A part of the supporting portion 264A is provided with a guiding portion 266A which has a plane intersecting both the Z-direction and the X-direction. In other words, the guiding portion 266A is formed as a part of the supporting portion 264A. The guiding portion 266A is positioned toward the positive Z-side (upward) of the contact point 262A. When the receptacle 200A is mated with the plug 100A (see FIG. 18), each of the guiding portions 266A guides the mating contact point 162A of the corresponding plug terminal 150A which is moved relative to the receptacle 200A toward the negative Z-direction (downward), so that each of the contact points 262A is connected to the mating contact point 162A of the corresponding plug terminal 150A. As shown in FIGS. 24 to 26, an end of the first portion 260A of the receptacle terminal 250A far from the contact point 262A extends toward the negative Y-direction.

As shown in FIGS. 23 to 26, the second portion 270A has a mounted portion 274A which is mounted and fixed to the circuit board (not shown) as the object by soldering. As shown in FIGS. 24 to 26, an end of the second portion 270A of the receptacle terminal 250A far from the mounted portion 274A extends toward the negative Y-direction.

As best illustrated in FIG. 26, in the present embodiment, the first portion 260A is positioned at a position same as a position of the second portion 270A in the Y-direction. Specifically, the contact point 262A is positioned at a position same as a position of the mounted portion 274A in the Y-direction. Especially, a center of the contact point 262A in the Y-direction is aligned with a center of the mounted portion 274A in the Y-direction.

In the present embodiment, each of the receptacle terminals 250A has a coupling portion 280A. The coupling portion 280A couples an end of the first portion 260A with an end of the second portion 270A. Accordingly, an allowable region 285A is formed next to the coupling portion 280A in the Y-direction. In detail, the allowable region 285A is formed at a position toward the positive Y-side of the receptacle terminal 250A shown in FIGS. 23 to 26. The allowable region 285A is sandwiched between the first portion 260A and the second portion 270A in the X-direction. As described later, when the receptacle 200A (see FIG. 23) is mated with the plug 100A (see FIG. 18), received parts 164A of the plug terminals 150A are received in the allowable regions 285A, respectively, so that the allowable regions 285A allow the received parts 164A of the plug terminals 150A to be positioned at positions same as positions of the coupling portions 280A in the Z-direction, respectively.

As best illustrated in FIG. 26, the coupling portion 280A is positioned at a position different from a position of the contact point 262A in the Y-direction. In other words, the coupling portion 280A is provided so as not to overlap with an imaginary line which passes the contact point 262A and extends in the X-direction.

As understood from FIGS. 21 and 23, under a condition where each of parts of the receptacle terminals 250A is received in the corresponding receiving portion 230A, each of parts of the first portions 260A is positioned in the corresponding ditch of the positioning projection 224A. Accordingly, when the receptacle 200A is mated with the plug 100A, the contact points 262A, the guiding portions 266A and the positioning projections 224A are unified to be inserted into the positioning holes 124A (see FIG. 18), respectively. Thus, each of the held portions 160A of the plug terminals 150A is sandwiched between the first portion 260A and the second portion 270A of the corresponding receptacle terminal 250A while each of the mating contact point 162A of the plug terminals 150A is contact with the contact point 262A of the corresponding receptacle terminal 250A in the corresponding receiving portion 230A. Specifically, under the condition where the receptacle 200A is mated with the plug 100A, each of the mating contact points 162A of the plug terminals 150A is positioned between the contact point 262A and the second portion 270A of the corresponding receptacle terminal 250A in the X-direction while each of the mating contact points 162A of the plug terminals 150A is in contact with the contact point 262A of the corresponding receptacle terminal 250A.

As shown in FIGS. 21 to 23, under a condition where the receptacle terminals 250A are held by the receptacle housing 210A, each of the mounted portions 274A is positioned within the space 228A. Specifically, each of the mounted portions 274A is positioned downward (toward the negative Z-side) of the side portion 226A. As understood from FIG. 23, under the condition where the receptacle terminals 250A are held by the receptacle housing 210A, each of the coupling portions 280A is positioned slightly upward (toward the positive Z-side) of the mounted portion 274A. Accordingly, each of the coupling portions 280 is deformable while the first portion 260A is movable in the Z-direction. In other words, each of the coupling portions 280A supports the first portion 260A so that the first portion 260A is movable at least in the Z-direction. However, the present invention is not limited thereto. The mounted portion 274A and the coupling portion 280A may be arranged on the common XY-plane. In other words, when the receptacle 200A is mounted on the circuit board (not shown) while each of the mounted portions 274A is fixed on the circuit board, each of the coupling portion 280A may be in contact with the circuit board.

As shown in FIGS. 21 and 23, in the present embodiment, each of the second portions 270A of the receptacle terminals 250A projects toward the positive Z-side (upward) from the side portion 226A. In other words, an area is provided between every neighboring second portions 270A in the Y-direction and above the side portion 226A.

As best illustrated in FIG. 26, each of the allowable regions 285A is formed between the contact point 262A and the second portion 270A, and the coupling portion 280A is not formed therebetween. In other words, the allowable regions 285A are formed next to the coupling portions 280A, respectively, in the Y-direction. As understood from FIGS. 27 to 30, when the receptacle terminals 250A are in contact with the plug terminals 150A, respectively (i.e. when the receptacle 200A is mated with the plug 100A), received parts 164A of the plug terminals 150A are received in the allowable regions 285A, respectively, while the received parts 164A of the plug terminals 150A are positioned at positions same as positions of the coupling portions 280A, respectively, in the Z-direction. Accordingly, a height of the held portion 160A can be increased (i.e. a size of the held portion 160A in the Z-direction can be increased), so that contact effective length of the contact point 262A can be increased. In other words, in the present embodiment, heights of the receptacle 200A and the plug 100A can be decreased while sufficient contact effective length can be ensured.

Figure 29:
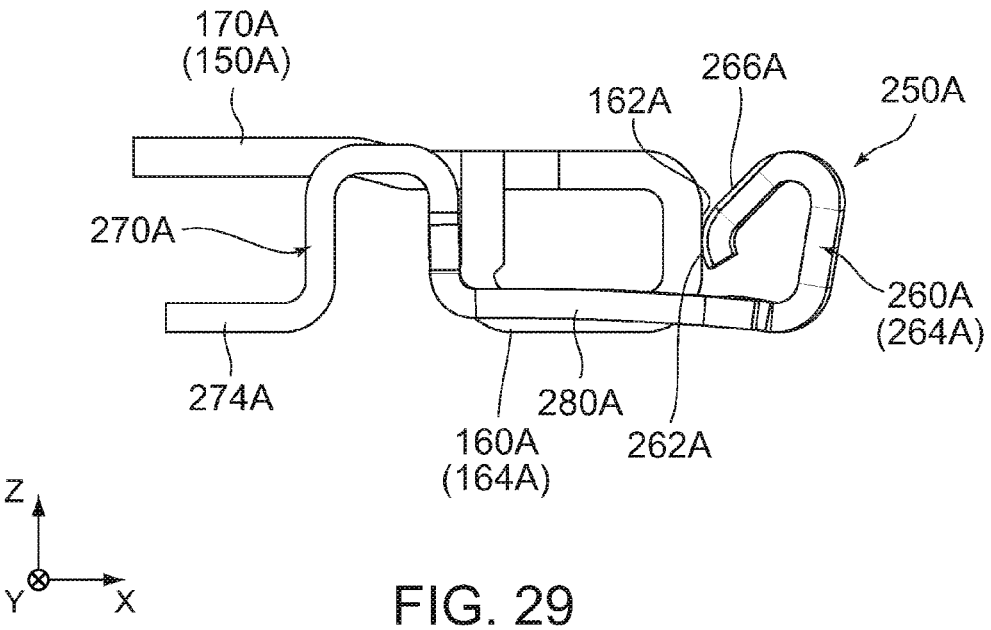
FIG. 29 is a side view showing the connection state of the plug terminal of FIG. 19 and the receptacle terminal of FIG. 24.
Figure 30:
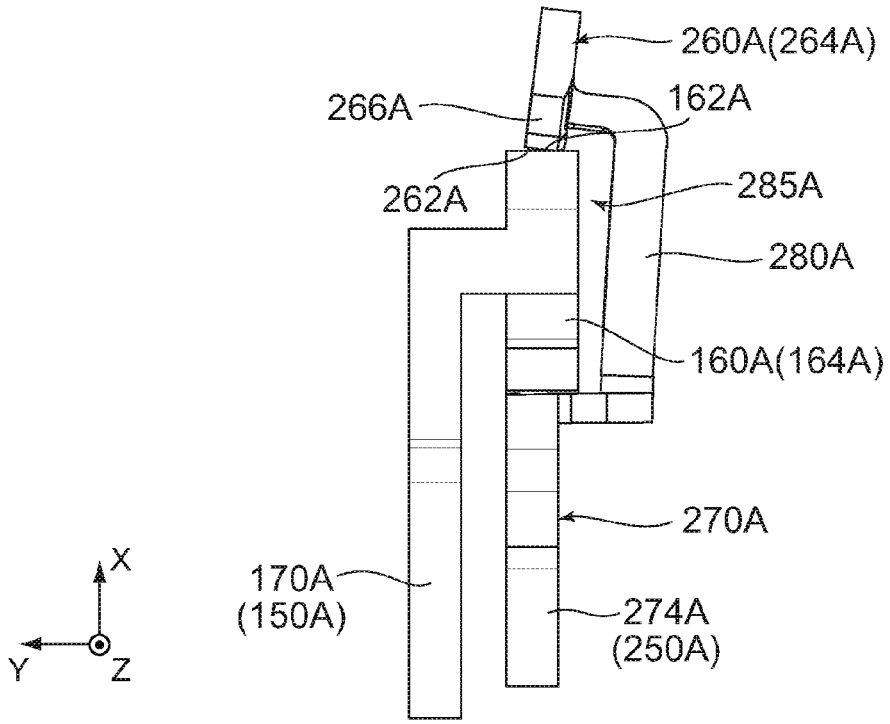
FIG. 30 is a plan view showing the connection state of the plug terminal of FIG. 19 and the receptacle terminal of FIG. 24.
Figure 31:
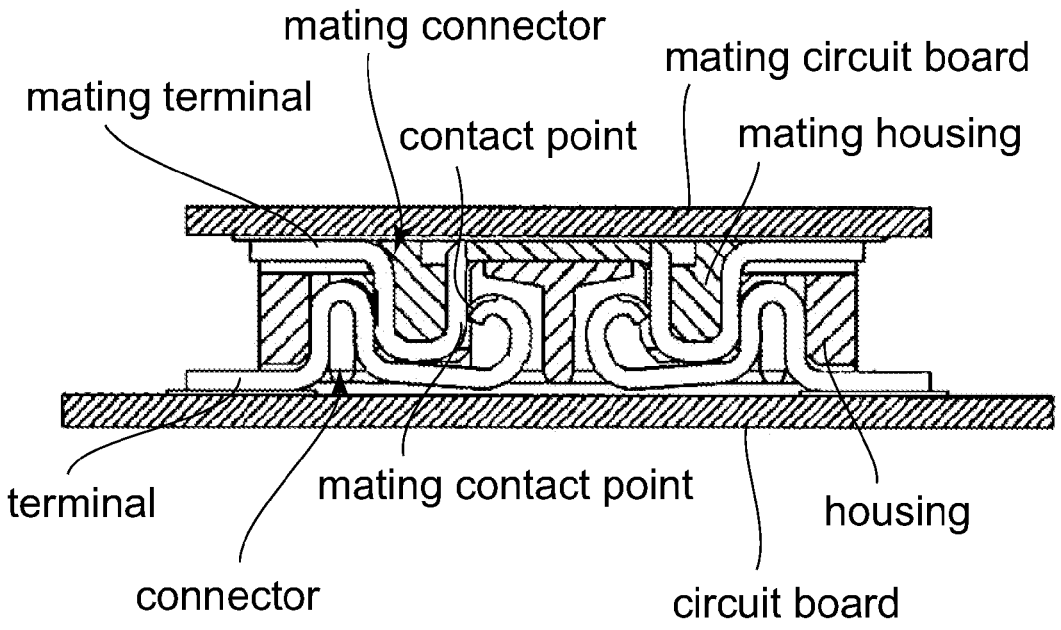
FIG. 31 PRIOR ART
FIG. 31 is a cross-sectional view showing a connector assembly of JP 2009-217943.

Especially, as understood from FIG. 30, the fixed portion 170A and the mounted portion 274A are positioned at positions different in the Y-direction from each other. Specifically, under the condition where the receptacle 200A is mated with the plug 100A, from a perspective plan view of the connector assembly from above (toward the positive Z-side), it is understood that the fixed portion 170A and the mounted portion 274A are provided so as not to overlap with each other. Since the area is provided between every neighboring second portions 270A in the Y-direction and above the side portion 226A, as described above, each of the fixed portions 170A can be positioned at the area. Accordingly, as shown in FIG. 29, under the condition where the receptacle 200A is mated with the plug 100A, the fixed portion 170A and a part of the second portion 270A can be positioned to align in the Y-direction. In other words, the fixed portion 170A can be positioned to overlap with a part of the second portion 270A in the Z-direction. Thus, according to the present embodiment, under the condition where the receptacle 200A is mated with the plug 100A, a size of the connector assembly in the Z-direction can be reduced.

Although, in the present embodiment, the mounted portion 274A is positioned at a position same as a position of the contact point 262A in the Y-direction, the present invention is not limited thereto. For example, the mounted portion 274A may be positioned at a position same as a position of the coupling portion 280A in the Y-direction.

In the aforementioned embodiments, under a condition where the receptacle 200 is mated with the plug 100, a part (i.e. held portion 160, 160A) which is sandwiched by the receptacle terminal 250, 250A consists only of a part of the plug terminal 150, 150A. For example, under a condition where the plug terminal 150, 150A is partly exposed on a part of the plug housing 110, 110A, or a condition where the plug terminal 150,150A is held by the part of the plug housing 110,110A, a part of the plug terminal 150, 150A and the part of the plug housing 110, 110A may be sandwiched by the receptacle terminal 250, 250A. Specifically, a part which is sandwiched by the receptacle terminal 250, 250A may be formed by the part of the plug terminal 150, 150A and an insulator such as the part of the plug housing 110, 110A. Although, in the aforementioned embodiment, the held portion 160, 160A is sandwiched only by the receptacle terminal 250, 250A, the held portion 160, 160A may be sandwiched by a part of the receptacle terminal 250, 250A and an insulator such as a part of the receptacle housing 210, 210A. Furthermore, the above-mentioned two modifications may be combined.

The present application is based on a Japanese patent application of JP2014-014459 filed before the Japan Patent Office on Jan. 29, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an up-down direction, the mating connector including a plurality of mating terminals each of which has a mating contact point, the connector being mounted to an object when used, the connector comprising:

a housing; and a plurality of terminals which are, at least in part, accommodated by the housing, the terminals corresponding to the mating terminals, respectively, the terminals being arranged in a first direction perpendicular to the up-down direction, each of the terminals having a first portion, a second portion and a coupling portion, the first portion including a contact point and a guiding portion, the contact point being positioned apart from the second portion in a second direction perpendicular to both the up-down direction and the first direction, the contact point being in contact with the mating contact point while the mating contact point is positioned between the contact point and the second portion in the second direction when the connector is mated with the mating connector, the guiding portion being positioned above the contact point, the mating contact point being moved downward in the up-down direction and being guided to the contact point by the guiding portion upon the mating of the connector with the mating connector, the second portion being fixed to the object when the connector is used, the coupling portion coupling the first portion with the second portion, and when viewed along the up-down direction, the coupling portion and the contact point do not overlap each other and are spaced apart from each other in the first direction.

2. The connector as recited in claim 1, wherein the first portion and the second portion are provided along a same line that is parallel to the second direction.

3. The connector as recited in claim 2, wherein:

each mating terminal has a held portion;

the mating contact point is provided at the held portion; and the first portion and the second portion sandwich the held portion when the connector is mated with the mating connector.

4. The connector as recited in claim 1, wherein the first portion includes a supporting portion which supports the contact point so that the contact point is movable in the second direction.

5. The connector as recited in claim 4, wherein the guiding portion is formed as a part of the supporting portion.

6. The connector as recited in claim 1, wherein the coupling portion supports the first portion so that the first portion is movable at least in the up-down direction.

7. The connector as recited in claim 1, wherein each of the plurality of terminals has a single coupling portion.

8. The connector as recited in claim 1, wherein each of the plurality of terminals has two coupling portions each of which couples the first portion with the second portion; and wherein when viewed along the up-down direction, the contact point does not overlap with either of the two coupling portions and is spaced apart from the two coupling portions in the first direction.

9. A connector assembly comprising the connector as recited in claim 1 and the mating connector mateable with the connector, wherein:

an allowable region is formed next to the coupling portion in the first direction; and when the connector is mated with the mating connector, a received part of a mating terminal is received in the allowable region of a corresponding terminal, such that, when viewed along the first direction, the received part of the mating terminal and the coupling portion of the corresponding terminal overlap each other.

10. The connector assembly as recited in claim 9, wherein:

the mating connector is to be mounted on a mating object;

the mating connector comprises the plurality of mating terminals and a mating housing which accommodates, at least in part, the mating terminals;

each of the mating terminals further includes a fixed portion which is to be fixed to the mating object; and under a condition where the connector is mated with the mating connector, when viewed along the up-down direction, the fixed portion and the second portion do not overlap each other.

11. The connector assembly as recited in claim 10, wherein when viewed along the up-down direction, the fixed portion and the mating contact point are spaced apart from each other in the first direction.

12. The connector assembly as recited in claim 10, wherein:

the mating terminals are arranged in the first direction;

the mating housing has separation portions which are positioned alternately with the mating terminals in the first direction; and each of the mating terminals projects beyond the separation portions in the up-down direction.

13. The mating connector mateable with the connector as recited in claim 1, wherein:

the mating connector comprises the plurality of mating terminals and a mating housing which accommodates, at least in part, the mating terminals;

the mating terminals are arranged in the first direction;

the mating housing has separation portions which are positioned alternately with the mating terminals in the first direction; and each of the mating terminals projects beyond the separation portions in the up-down direction.

* * * * *